US009162851B2

(12) United States Patent
Fan Jin Quan

(10) Patent No.: US 9,162,851 B2
(45) Date of Patent: Oct. 20, 2015

(54) COMB PLATE—COMB PLATE CARRIER ASSEMBLY AND COMBINATION CONSTRUCTION OF THE ASSEMBLY WITH LIFTING TOOL

(71) Applicant: KONE Corporation, Helsinki (FI)

(72) Inventor: Kevin Fan Jin Quan, Kunshan (CN)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/158,010

(22) Filed: Jan. 17, 2014

(65) Prior Publication Data

US 2014/0202827 A1 Jul. 24, 2014

(30) Foreign Application Priority Data

Jan. 18, 2013 (CN) ..... 2013 1 0018640

(51) Int. Cl.
*B66B 29/08* (2006.01)
*B66B 23/00* (2006.01)
*B66B 29/06* (2006.01)

(52) U.S. Cl.
CPC ..... *B66B 23/00* (2013.01); *B66B 29/06* (2013.01)

(58) Field of Classification Search
CPC ..... B66B 29/06; B66B 25/00
USPC ..... 198/322, 325
See application file for complete search history.

(56) References Cited

U.S. PATENT DOCUMENTS

| | | | | |
|---|---|---|---|---|
| 3,687,257 | A * | 8/1972 | Johnson | 198/325 |
| 4,476,971 | A | 10/1984 | Schoneweiss | |
| 5,611,417 | A * | 3/1997 | Stawniak et al. | 198/323 |
| 5,908,104 | A * | 6/1999 | Brun-Jarret | 198/324 |
| 6,068,107 | A * | 5/2000 | Brun-Jarret | 198/600 |
| 6,520,310 | B1 * | 2/2003 | Lauch et al. | 198/323 |
| 7,234,583 | B2 | 6/2007 | Illedits et al. | |
| 2004/0134748 | A1 | 7/2004 | Tada | |
| 2005/0016816 | A1 * | 1/2005 | Diaz | 198/325 |
| 2006/0096834 | A1 | 5/2006 | Illedits et al. | |

FOREIGN PATENT DOCUMENTS

| | | | |
|---|---|---|---|
| CN | 85 1 06338 | A | 9/1986 |
| CN | 1099003 | A | 2/1995 |
| CN | 1772590 | A | 5/2006 |
| CN | 1888853 | A | 11/2006 |
| CN | 102020188 | A | 4/2011 |
| CN | 201864440 | U | 6/2011 |
| CN | 203295011 | U | 11/2013 |
| EP | 0 622 326 | A1 | 11/1994 |
| JP | 2003-237917 | A | 8/2003 |

* cited by examiner

*Primary Examiner* — James R Bidwell
(74) *Attorney, Agent, or Firm* — Birch, Stewart, Kolasch & Birch, LLP

(57) ABSTRACT

A comb plate-comb plate carrier assembly for an escalator is disposed on an upper and lower head and mounted to the truss of the escalator. A comb plate and a pair of comb plate carriers for carrying the comb plate are included. The assembly is provided with at least one of: a guide rail bracket fastened to the comb plate carrier and used to fix a guide rail for the handrail belt; a supporting bracket fastened to the comb plate carrier and used to support an end of a handrail return-sheave curve fastened to the truss; a comb plate height adjuster; a monitoring device for monitoring the horizontal displacement and upward displacement of the comb plate. A combination structure includes a lifting tool and the assembly in an assembled condition, the lifting tool includes a traverse rod and a longitudinal suspending member.

32 Claims, 19 Drawing Sheets

COMB PLATE—COMB PLATE CARRIER ASSEMBLY AND COMBINATION CONSTRUCTION OF THE ASSEMBLY WITH LIFTING TOOL

TECHNICAL FIELD

The present invention relates to a comb plate-comb plate carrier assembly for an escalator or a moving walk, and also relates to a combination construction comprising a lifting tool and a comb plate-comb plate carrier assembly in an assembled condition.

BACKGROUND OF THE INVENTION

It is well known that the escalator, the moving walk and the like comprise heads, and elements of the head, including comb plate carriers, a comb plate, balustrade brackets, skirt fastening brackets, a handrail belt inlet bracket and etc., are either mounted separately on a truss of the escalator or moving walk and adjusted individually, or mounted on the truss of the escalator or moving walk after being pre-assembled as a sub-assembly. In addition, the existing escalator and moving walk are usually provided with a monitoring device for monitoring the position of the comb plate. During the operation of the escalator, the monitoring device is used to monitor backward displacement of the comb plate due to abnormal situations such as the collision between steps and the comb plate or objects being stuck between the steps and the comb plate, the backward displacement of the comb plate will actuate a safety switch so as to stop the operation of the escalator.

U.S. Pat. No. 7,234,583B2 has disclosed a comb plate-comb plate carrier sub-assembly for an escalator or a moving walk, and a monitoring device for monitoring the position of the comb plate.

The comb plate-comb plate carrier sub-assembly disclosed in the reference document is pre-assembled beforehand. In order to hold the relative positions of components, especially the comb plate and the comb plate carriers, during transportation and assembling, the comb plate itself is used as a positioning and connecting element, and is securely fastened to the comb plate carriers on both sides by bolts, so that the comb plate and the comb plate carriers form a rigid unit. After the sub-assembly is mounted onto the truss, the bolts as fastening elements are removed so as to allow the horizontal displacement of the comb plate. However, during installation, it requires additional tools to lift and mount the comb plate-comb plate carrier sub-assembly on the truss, leading to inconvenient, time-consuming and costly mounting.

The monitoring device disclosed in the reference document can only monitor the backward displacement of the comb plate due to abnormal situations during the operation of the escalator, but can not monitor the upward displacement of the comb plate due to abnormalities during the operation of the escalator. However, there exists such a situation that the comb plate is displaced upward due to abnormal situations such as the collision between steps and the comb plate or objects being stuck between the steps and the comb plate during the operation of the escalator. So the monitoring device disclosed in the reference document can not fully monitor the abnormal situations of the escalator.

In view of the above problems of the traditional comb plate-comb plate carrier assembly and the monitoring device for monitoring the position of the comb plate, there are requirements for further improving the comb plate-comb plate carrier assembly and the monitoring device.

SUMMARY OF THE INVENTION

In order to overcome the defects in the traditional technology, the object of the present invention is to provide a comb plate-comb plate carrier assembly, which has a relatively simple structure and facilitates assembling and position adjustment.

Another object of the present invention is to provide a monitoring device for monitoring the position of the comb plate, which may monitor not only the backward displacement of the comb plate due to abnormal situations but also the upward displacement of the comb plate due to abnormal situations, so as to realize overall monitoring of various abnormal situations.

A further object of the present invention is to provide a combination construction comprising a lifting tool and a comb plate-comb plate carrier assembly, which can not only maintain the positional relationship between the components during transportation and lifting and installation, but also facilitate the final assembly of the comb plate-comb plate carrier assembly on the truss.

In order to realize the aforementioned and other objects, according to a first aspect of the present invention, there provided a comb plate-comb plate carrier assembly for an escalator or a moving walk, said escalator or moving walk comprising steps or pallets, and a balustrade with a handrail, said assembly being arranged on a head of the escalator or moving walk and being mounted on a truss of the escalator or moving walk;

wherein said comb plate-comb plate carrier assembly comprising:

a comb plate; and a pair of opposed comb plate carriers for carrying the comb plate;

wherein said comb plate-comb plate carrier assembly being provided with at least one of the following items:

(a) a guide rail bracket which is fastened to the comb plate carrier and is used to fix a guide rail for the handrail belt, the guide rail bracket comprising a mounting portion and a fixing portion, said mounting portion being fastened to the comb plate carrier, and said fixing portion being formed with a hole and fixing the handrail belt guide rail by means of a bolt extending through the hole;

(b) a supporting bracket which is fastened to the comb plate carrier and is used to support an end of a handrail return-sheave curve fastened to the truss;

(c) comb plate height adjusting means which is provided at either lateral end of said comb plate on a side of the comb plate facing away from the comb for adjusting the height of the comb plate;

(d) monitoring device for monitoring the horizontal displacement and upward displacement of the comb plate.

According to another aspect of the present invention, there is provided a combination structure, comprising a lifting tool and a comb plate-comb plate carrier assembly in an assembled condition, wherein:

the comb plate-comb plate carrier assembly comprises:

a comb plate, and a pair of opposed comb plate carriers for carrying the comb plate;

the lifting tool comprising:

a traverse rod;

a longitudinal suspending member which is provided substantially perpendicular to the traverse rod, one end of the longitudinal suspending member is attached to the traverse rod at the central portion of the traverse rod;

engaging means which is provided at the other end of the longitudinal suspending member and engages with the comb plate;

a lifting eye arranged on the longitudinal suspending member;

wherein the ends of the traverse rod are respectively fixedly connected to the corresponding comb plate carriers, so as to fix and maintain the positional relationship between the two comb plate carriers and the comb plate; and the engaging means engages with the comb plate.

With the technical solution of the present invention, not only the positional relationship between the components of the comb plate-comb plate carrier assembly is maintained during transportation and lifting, but also the final assembly of the comb plate-comb plate carrier assembly on the truss is facilitated. Furthermore, the monitoring device for monitoring the position of the comb plate of the present invention can monitor not only backward displacement of the comb plate due to abnormal situations but also upward displacement of the comb plate due to abnormal situations, so as to realize overall monitoring of various abnormal situations and to ensure safe operation of the escalator, the moving walk and etc.

BRIEF DESCRIPTION OF THE DRAWINGS

The invention is further described in detail in combination with the accompanying drawings and the embodiments, wherein.

DETAILED DESCRIPTION OF THE EMBODIMENTS

The comb plate-comb plate carrier assembly for an escalator or a moving walk and the combination construction comprising a lifting tool and a comb plate-comb plate carrier assembly in an assembled condition of the present invention will be hereinafter described in detail. It shall be understood that the embodiments of the present invention are given by way of illustration only, they are used for explaining the principles of the invention but not limiting the invention. Furthermore, it is obvious for those skilled in the art that the inventive contents of the present application may be used for various conveying apparatuses adopting the comb plate-comb plate carrier assembly including escalators.

Figure 1:
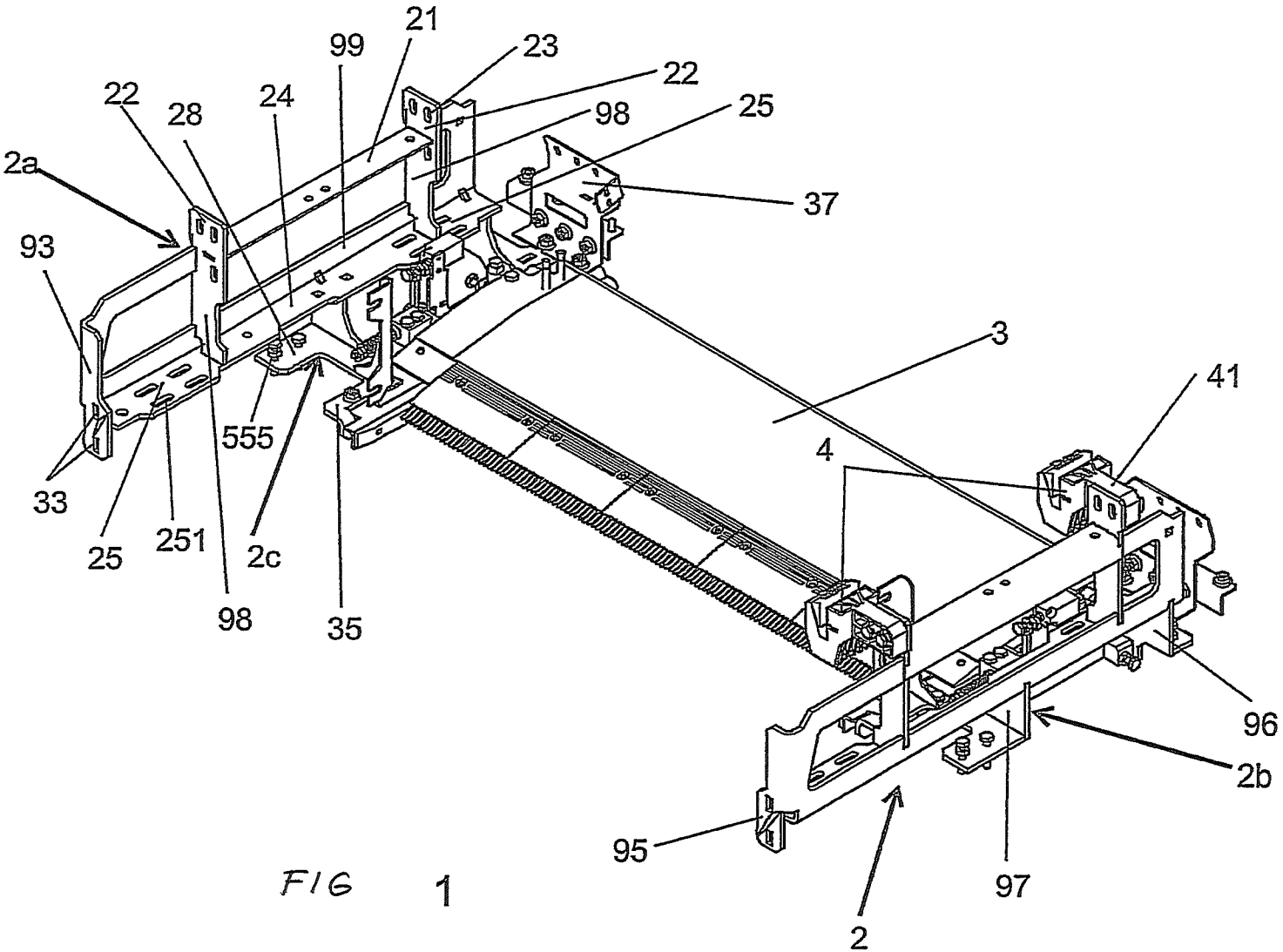
FIG. 1 is an isometric view showing a comb plate-comb plate carrier assembly according to the present invention.

Reference is first made to FIG. 1 which shows the comb plate-comb plate carrier assembly of the present invention in a perspective view.

As shown in FIG. 1, the comb plate-comb plate carrier assembly comprises a comb plate carrier 2 on either side of a comb plate 3, the two comb plate carriers 2 together carry the comb plate 3.

Each of the comb plate carriers 2 comprises the following parts: an upper part 2*a* having a substantially C-shaped cross-section profile, a middle part 2*b* extending vertically downward from the upper part, and a lower part 2*c* positioned substantially perpendicular to the middle part.

Figure 2:
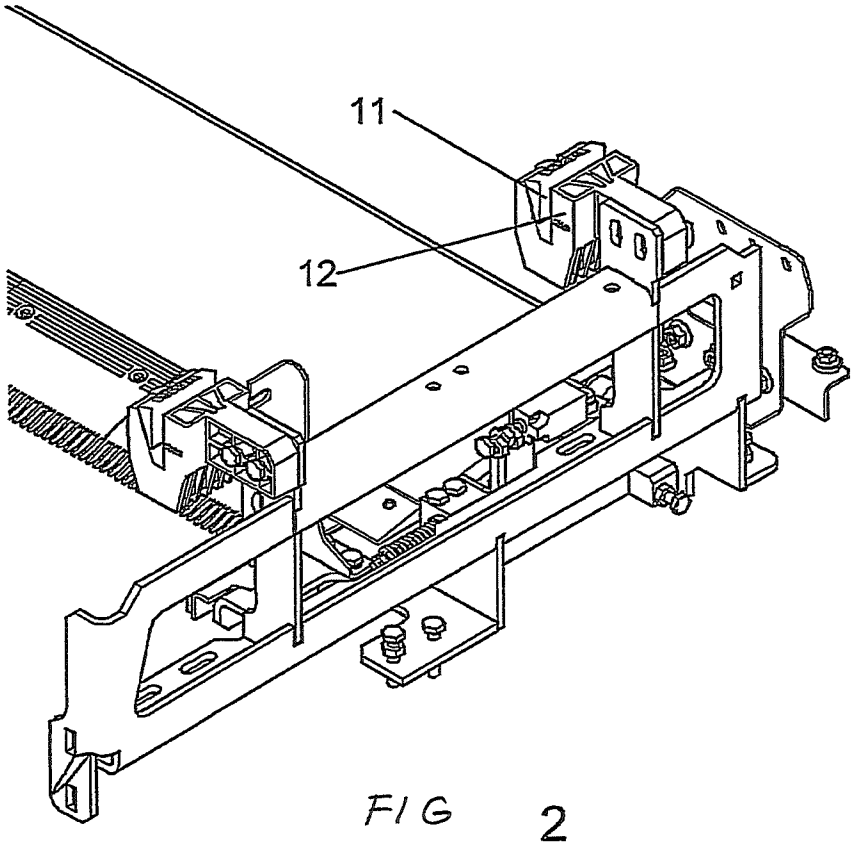
FIG. 2 is an isometric view showing the mounting of a balustrade bracket on the comb plate carrier.

As shown in FIGS. 1 and 2, the upper part 2*a* comprises an upper bending section 21, two ends of the upper bending section 21 in a longitudinal direction are spaced by a distance from the respective ends of the comb plate carrier; and a lower bending section 24. Two rib plates 98 are respectively welded to the upper part 2*a* at the positions where the two ends of the upper bending section 21 in a longitudinal direction are located, lower ends of the rib plates 98 abut against the lower bending section 24 of the upper part 2*a*, and the rib plates 98 are perpendicular to the longitudinal direction of the comb plate carrier. The rib plates 98 protrude upward from the upper bending section 21, the protruding portion forming a mounting lug 22.

The middle part 2*b* comprises two plate members 96 and 97 that are perpendicular to the longitudinal direction of the comb plate carrier, the two plate members are connected to the upper part 2*a* and the lower part 2*c* through welding.

As shown in FIGS. 1 and 2, two balustrade brackets 4 are mounted on the upper part 2*a*. The two balustrade brackets or glass brackets 4 are used for carrying the balustrade or glass balustrade, to this end, each of the balustrade brackets 4 is formed with a mounting slot 11, into which the lower end of the balustrade is inserted. The two balustrade brackets 4 are respectively mounted to the corresponding mounting lug 22. In order to mount the balustrade brackets, each mounting lug 22 is formed with two elongated holes 23 extending in vertical direction; and correspondingly, the balustrade brackets 4 comprises a fixing portion 41, two mounting holes are formed in the fixing portion. Thus, the balustrade bracket is mounted to the comb plate carrier 2 through bolts, as shown in FIG. 2. By forming the holes 23 in the mounting lug 22 as elongated ones, the height position of the balustrade brackets 4 relative to the comb plate carrier may be adjustable in a vertical direction.

Further referring to FIG. 1, two carrier mounting portions 25 are formed on the lower side of the C-shaped profile of the upper part 2*a*, and specifically on the lower bending section 24 of the C-shaped profile of the upper part, at the positions adjacent to the ends of the lower bending section, the comb plate carrier is fastened to the truss of an escalator by means of the mounting portions. As shown in the figures, each carrier mounting portion 25 is formed with four elongated holes 251, through which the comb plate carrier is fastened by bolts to the truss of an escalator or other structural members fixed to the truss of an escalator.

Figure 3B:
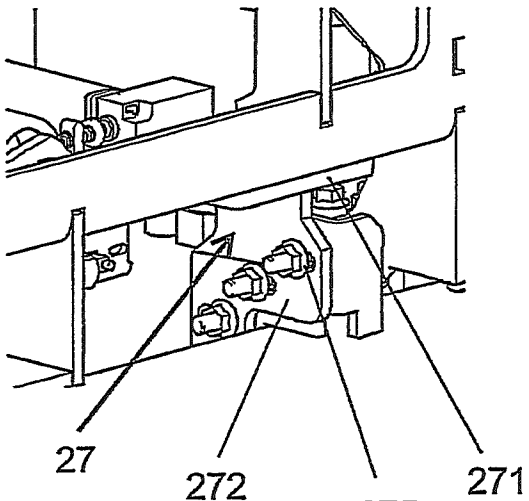
FIGS. 3A and 3B are isometric views showing fastening means for mounting the comb plate carrier onto an escalator truss.
Figure 3A:
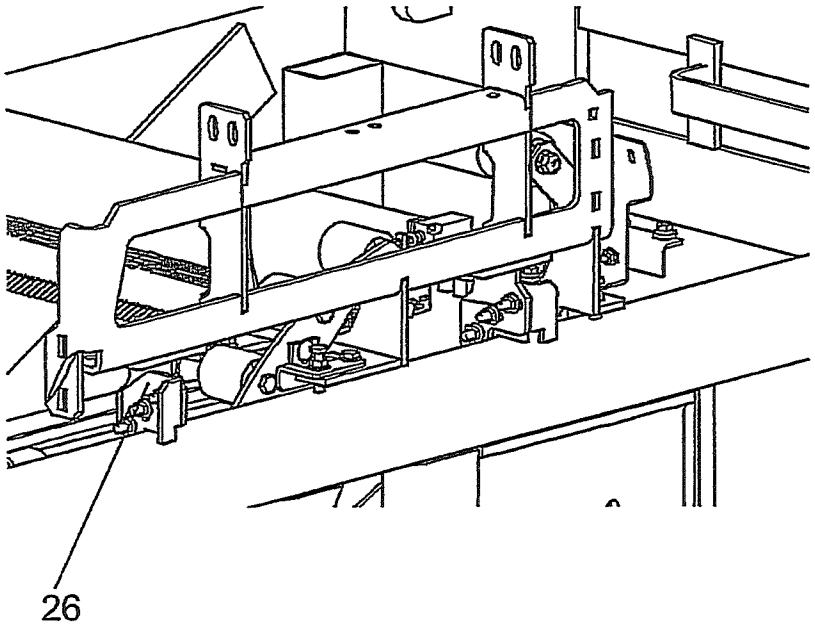
Figure 4:
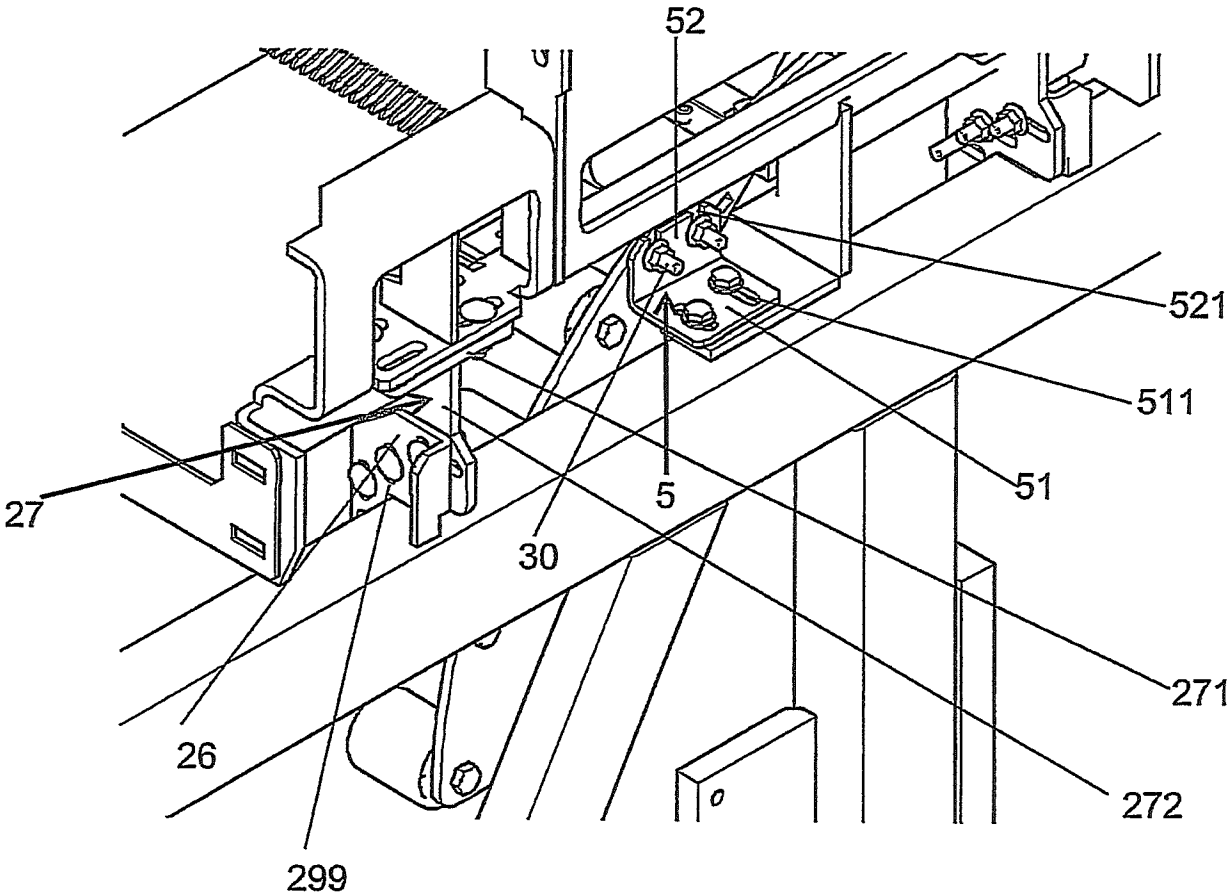
FIGS. 4 and 4A are isometric views showing a supporting bracket for fastening and supporting a handrail return-sheave curve.

FIGS. 3A, 3B and 4 show a way of fastening the comb plate carrier to the truss of an escalator. As shown in the figures, an L-shaped bracket 26 is fastened to the truss by such connecting manners as welding, the L-shaped bracket is formed with elongated holes 299 extending in vertical direction to allow bolts to pass through, as shown in FIG. 4. A middle bracket 27 is in a form of T-shaped plate and comprises a panel 271 in contact with the carrier mounting portion 25 and a panel 272 in contact with the L-shaped bracket 26. The panel 271 in contact with the carrier mounting portion 25 is formed with holes corresponding to the elongated holes in the carrier mounting portion and allowing bolts to pass through, while the panel 272 in contact with the L-shaped bracket 26 is formed with elongated holes 275 extending in lateral direction and corresponding to the holes on the L-shaped bracket, as shown in FIG. 3B. When fastening the comb plate carrier to the truss of an escalator, the middle bracket 27 is on one hand connected to the comb plate carrier by bolts, and on the other hand connected to the L-shaped bracket 26 by bolts, whereby the comb plate carrier 2 is fastened to the truss of an escalator. By means of the elongated holes formed on the carrier mounting portion 25, the elongated holes formed on the middle bracket 27 and the elongated holes formed on the L-shaped bracket 26, the fastening position of the comb plate carrier relative to the truss of an escalator can be adjusted in the longitudinal direction, the lateral direction and the vertical direction.

Figure 4A:
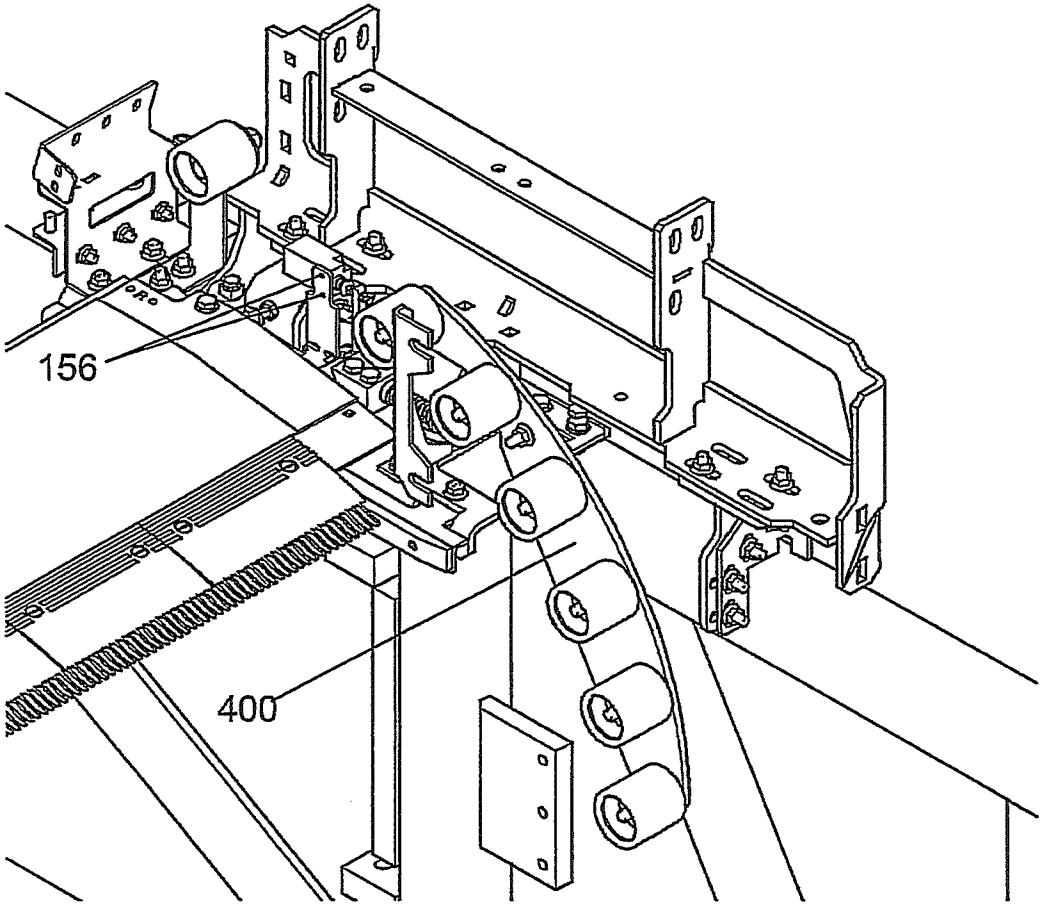
Figure 4B:
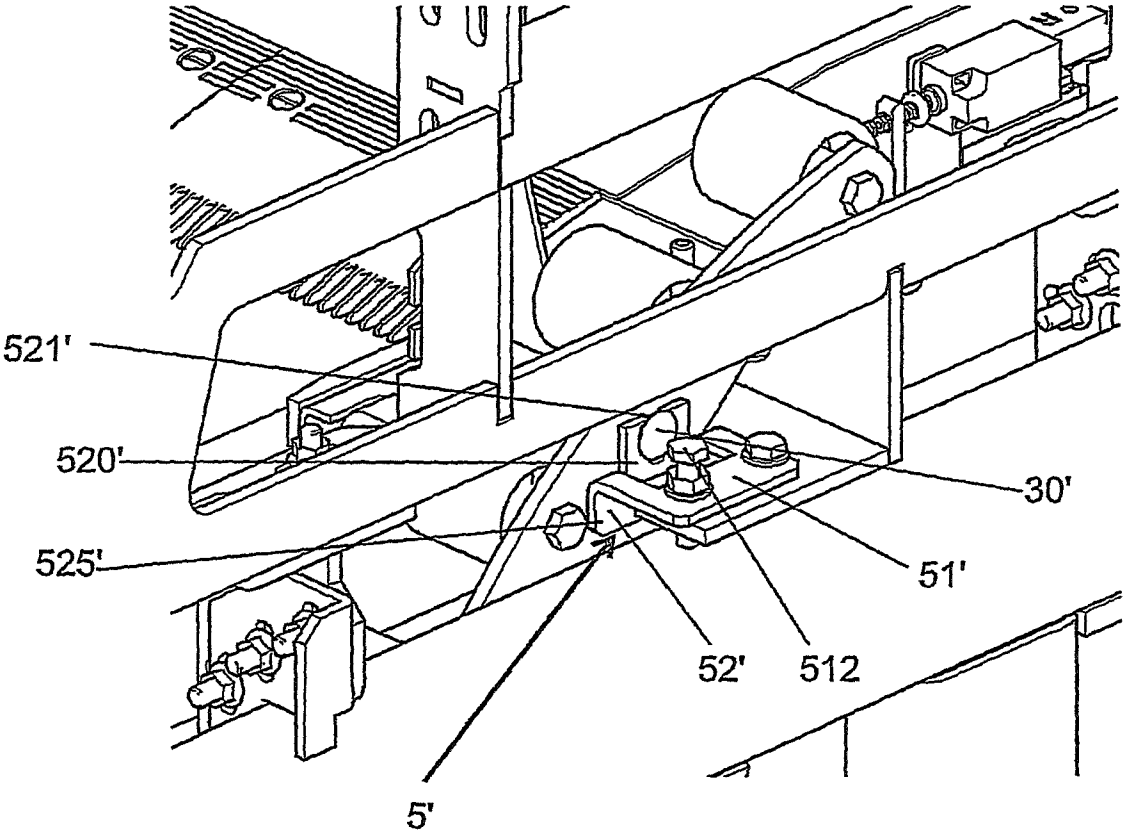
FIG. 4B is an isometric view showing another embodiment of the supporting bracket for fastening and supporting a handrail return-sheave curve.

Further referring to FIG. 1, a fixing portion 28 is provided at a substantially middle position of the lower part 2*c* of the comb plate carrier 2 on a side facing away from the comb plate, for mounting a supporting bracket used to support an end of a handrail return-sheave curve 400 (see FIGS. 4 and 4A, 4B). As shown in FIG. 1, two holes 255, which allow bolts to pass through, are formed on the fixing portion. As shown in FIG. 4, the supporting bracket 5 is in a form of angle plate and comprises a mounting portion 51 and a supporting portion 52 substantially perpendicular to each other, the mounting portion 51 being connected to the comb plate carrier 2 and the supporting portion 52 being connected to the end of the handrail return-sheave curve. The mounting portion 51 is formed with two elongated holes 511 and fastened to the fixing portion 28 by bolt. By means of the elongated holes 511, the lateral position of the supporting bracket 5 relative to the comb plate carrier can be adjusted. The supporting portion 52 is formed with two elongated holes 521 open upward. Two positioning pins 30 are provided to the end of the handrail return-sheave curve of the escalator, the two positioning pins are spaced apart from each other by a distance in the length direction of the comb plate carrier and are preferably offset in a vertical direction. While being assembled, the two positioning pins are respectively disposed in the corresponding elongated holes 521 and fastened by nuts, thereby to fix and support the handrail return-sheave curve. By the way, although the number of the elongated holes 521 and the positioning pins 30 is two in the embodiment, it is obvious for those skilled in the art that the number may be one or more.

FIG. 4B shows another form of the supporting bracket for supporting the end of the handrail return-sheave curve 400. The supporting bracket 5' is in a form of punched bended plate and generally in a T shape, and comprises a mounting portion 51' and a supporting portion 52' substantially perpendicular to each other, the mounting portion 51' being connected to the comb plate carrier 2 and the supporting portion 52' being connected to the end of the handrail return-sheave curve. Preferably, the supporting bracket 5' is formed in the following manner: as shown in FIG. 4B, the supporting portion 52' comprises two parts, i.e. a lower part 525' located at a lower side relative to the mounting portion 51', and an upper part 520' located at an upper side relative to the mounting portion 51', wherein the upper part 520' is formed by forming a cutout of U shape in the mounting portion 51' and bending the portion surrounded by the cutout, and the lower part 525' and the upper part 520' are coplanar. The mounting portion 51' is formed with two holes and fastened to the fixing portion 28 by bolts 512. The upper part 520' of the supporting portion 52' is formed with a hole 521', preferably an elongated hole, open upward, and a positioning pin 30' are provided to the end of the handrail return-sheave curve of the escalator. While being assembled, similar to the embodiment shown in FIG. 4, the positioning pin is disposed in the corresponding hole 521' and fastened by a nut, thereby to fix and support the handrail return-sheave curve. The end of the handrail return-sheave curve may be connected to the supporting bracket by other means, e.g. by rivet connection, as shown in FIG. 4B, wherein the positioning pin 30' may be used as a rivet.

Figure 5B:
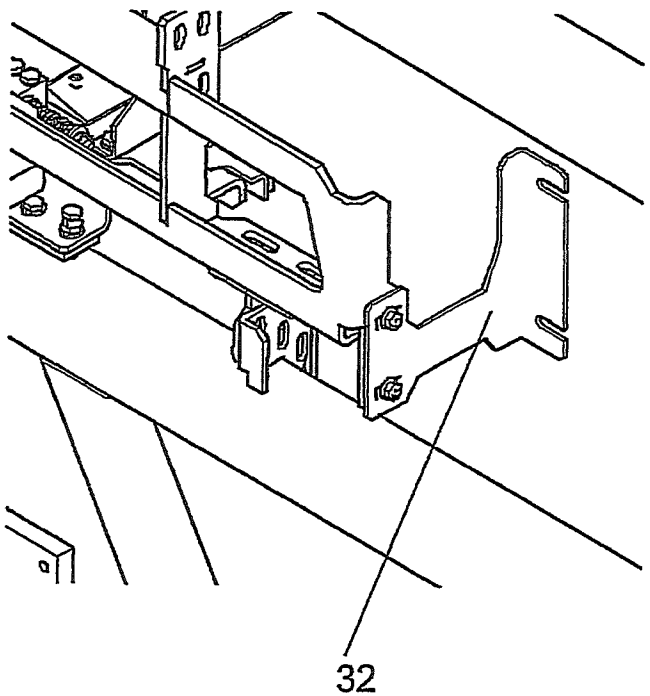
FIGS. 5A and 5B are isometric views showing a skirt fastening bracket fastened to the comb plate carrier.
Figure 5A:
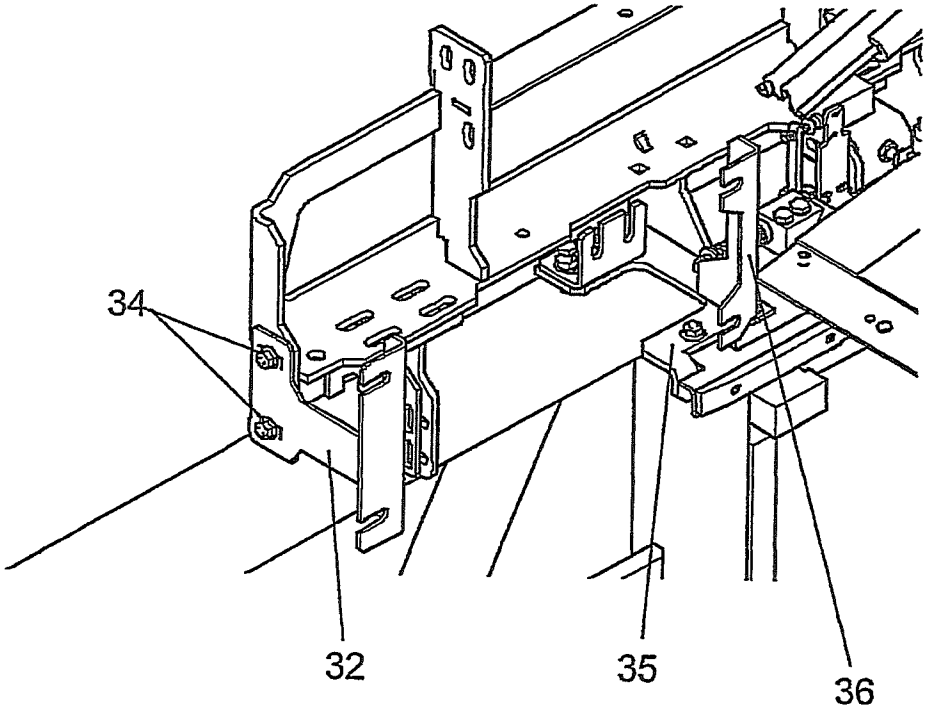

Next referring to FIGS. 1 and 5A, 5B, the middle section of the upper part 2*a*, and specifically an intermediate connecting panel 99 of the C-shaped profile of the upper part, is provided with a bending portion 93 at a proximal end thereof, the bending portion including an extension part 95 extending downward beyond the lower bending section 24. The extension part is formed with holes and used as a mounting plate for mounting a first skirt bracket 32, by means of the first skirt bracket the skirt is mounted and correctly positioned with respect to the comb plate. The mounting plate is formed with two holes 33 allowing the bolt to pass through, and the panel of the first skirt bracket in contact with the mounting plate is also formed with two corresponding holes 34 for bolts, whereby the first skirt bracket 32 is fastened to the comb plate carrier 2 by bolts. The two holes of at least one of the mounting plate and the first skirt bracket 32 are formed as elongated holes, and preferably, the holes of both of the two members are formed as elongated holes and the extending directions of the elongated holes are perpendicular to each other, whereby the lateral position and the height position of the first skirt bracket relative to the comb plate carrier can be adjusted. In addition, as shown in FIGS. 1 and 5A, 5B, another fixing portion 35 is provided at a substantially middle position of the lower part 2*c* of the comb plate carrier 2 on a side adjacent to the comb plate, a second skirt bracket 36 is fastened to the another fixing portion 35, be means of the second skirt bracket 36 the skirt is mounted and correctly positioned with respect to the comb plate. Similar to the first skirt bracket 32, the second skirt bracket is fastened to the another fixing portion 35 also by bolt, and its lateral position can be adjusted with respect to the comb plate carrier.

Figure 6:
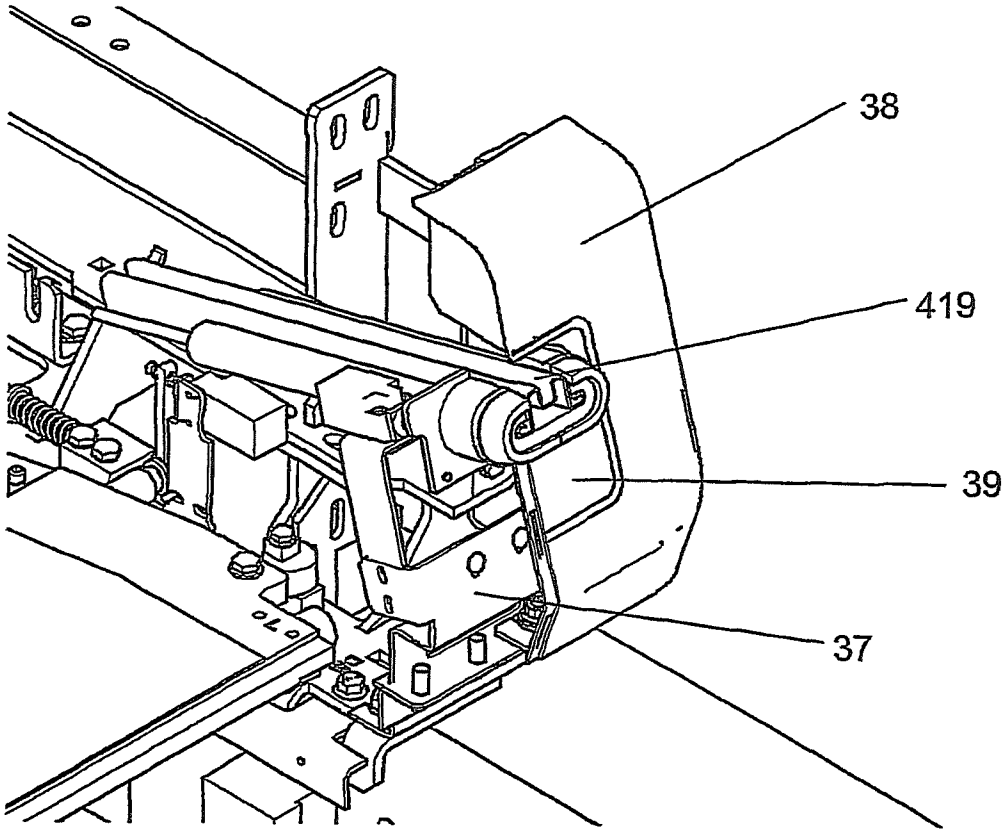
FIG. 6 is an isometric view showing a handrail inlet assembly mounted to the handrail belt inlet bracket.

Next referring to FIGS. 1 and 6, a handrail belt inlet bracket 37 is mounted at a distal end of the lower part 2*c* of the comb plate carrier 2. As well known to those skilled in the art, a handrail inlet cover plate 38 and a handrail inlet panel 39, which together form a handrail inlet assembly, are mounted to the handrail belt inlet bracket by bolts.

Figure 7A:
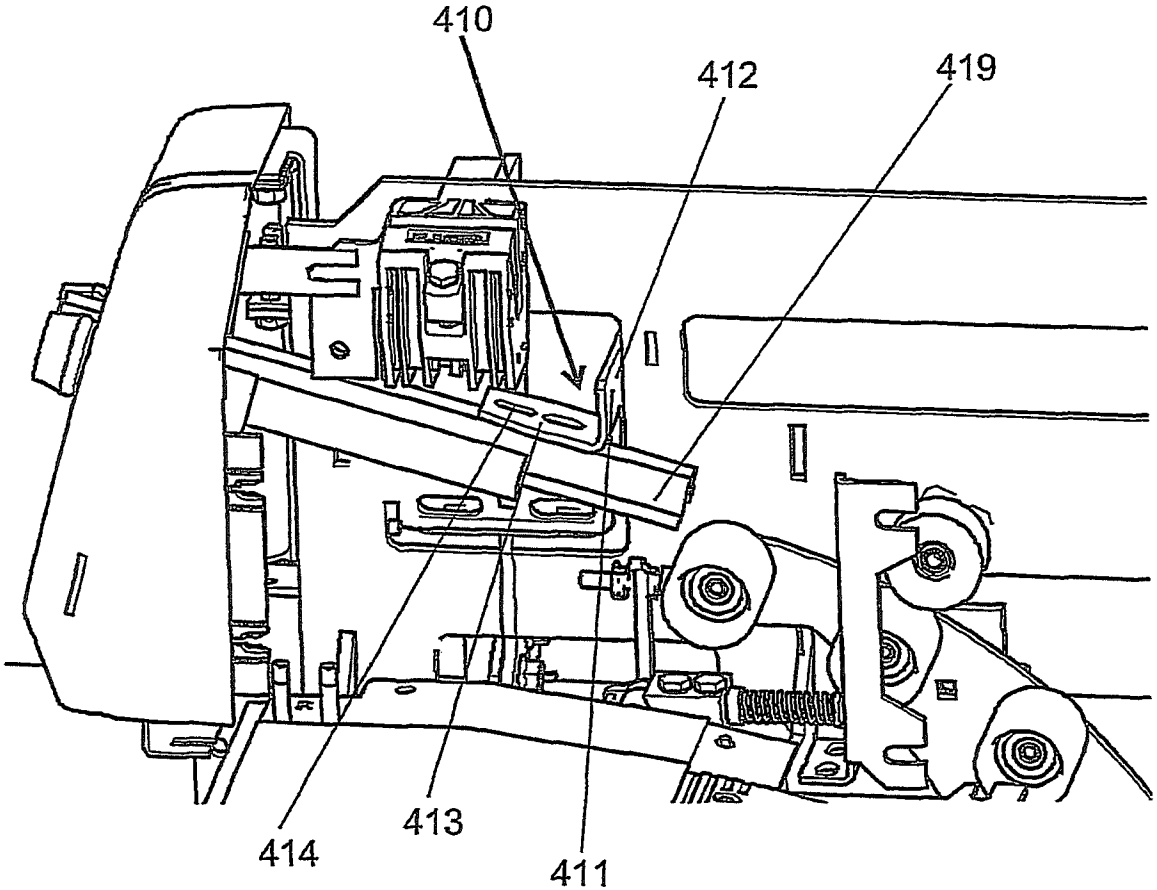
FIG. 7A is an isometric view showing an embodiment of the bracket for fastening a handrail belt guide rail.

As shown in FIG. 1, a bracket 140 may be fastened to the rib plate 98, which is located at a distal end of the upper part of the comb plate carrier 2, by such means as bolts or welding, the bracket is used for fixing a guide rail 419 of the handrail belt. As shown in FIGS. 6 and 7A, the bracket is mounted to a portion of the rib plate 98 between the upper bending section and the lower bending section and is mounted on a side of the rib plate facing the inlet bracket 37. As shown in FIG. 7A, a bracket 410 is in a form of angle plate and comprises a mounting portion and a fixing portion. The mounting portion 411 of the bracket 410 includes an extension part 412 extending outward in lateral direction, the bracket 410 is fastened to the rib plate 98 by means of the extension part. The fixing portion 413 and the mounting portion 411 form a desired angle such that the fixing portion 413 of the bracket preferably are substantially parallel to the guide rail of the handrail belt in an assembled state. The fixing portion 413 of the bracket is formed with two holes 414, preferably elongated holes, so that the guide rail of the handrail belt is fastened to the bracket by means of bolts passing through the holes. In order to fix the guide rail of the handrail belt, threaded holes may be formed on the guide rail of the handrail belt, or alternatively, nuts may be welded to the guide rail of the handrail belt.

Figure 7B:
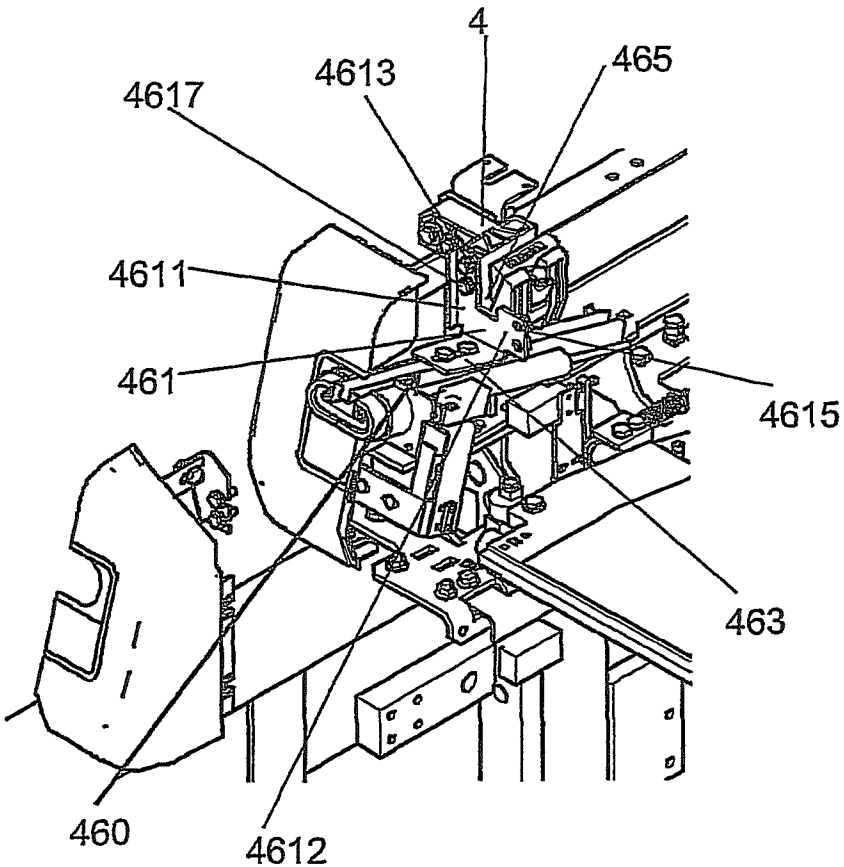
FIG. 7B is an isometric view showing another embodiment of the bracket for fastening a handrail belt guide rail.
Figure 7C:
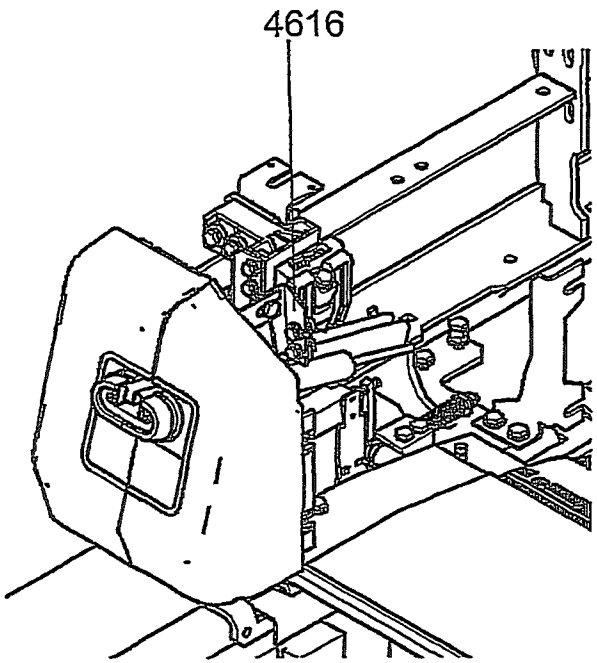
FIG. 7C is an isometric view showing the bracket shown in FIG. 7B being fastened to the comb plate carrier and its connection with the inlet panel bracket.

FIG. 7B and FIG. 7C show another embodiment of the bracket of the present invention. Similar to the above embodiment, as shown in FIG. 7B, the bracket 460 of this embodiment is also in a form of angle plate and comprises a mounting portion 461 and a fixing portion 463. The difference from the above embodiment is that the mounting portion is not fastened to the rib plate 98 of the comb plate carrier 2 but fastened to the balustrade bracket 4. In order not to interfere with the balustrade, the mounting portion 461 is formed with a cutout 465, which delimits a first mounting portion 4611 and a second mounting portion 4612. The first mounting portion 4611 is formed with two mounting holes for fastening the bracket by bolts 4617 to the balustrade bracket 4 at the proximal end. Accordingly, an end face of the slot wall 12 (see FIG. 2) of the mounting slot 11 of the balustrade bracket 4, which is remote from the comb plate, is formed with corresponding mounting holes (not shown). In addition, the second mounting portion 4612 is formed with two mounting holes 4615, for fastening the inlet panel bracket 4616 by bolts, as shown in FIG. 7C.

As shown in FIGS. 8A-10, a cutout 45 is formed at either lateral end of the comb plate at the distal end of the comb plate, and a comb plate height adjusting means 50 is provided at the cutout. In the shown embodiment, the comb plate height adjusting means is in a form of an eccentric roller device, comprising a roller 51 and a roller shaft 52 on which the roller is eccentrically mounted, and the roller shaft 52 is attached to a downward projecting part 55 of the comb plate. The comb plate height adjusting means 50 may be arranged in such way that the roller shaft is fixedly mounted to the comb plate while the roller may rotate about the roller shaft; or that the roller shaft is rotatably mounted to the comb plate while the roller may rotate together with the roller shaft. By rotating the roller, the height position of the comb plate in vertical direction can be adjusted.

Next referring to FIGS. 1, 9 to 13C, a monitoring device according to the present invention for monitoring the position of the comb plate is shown.

Figure 8B:
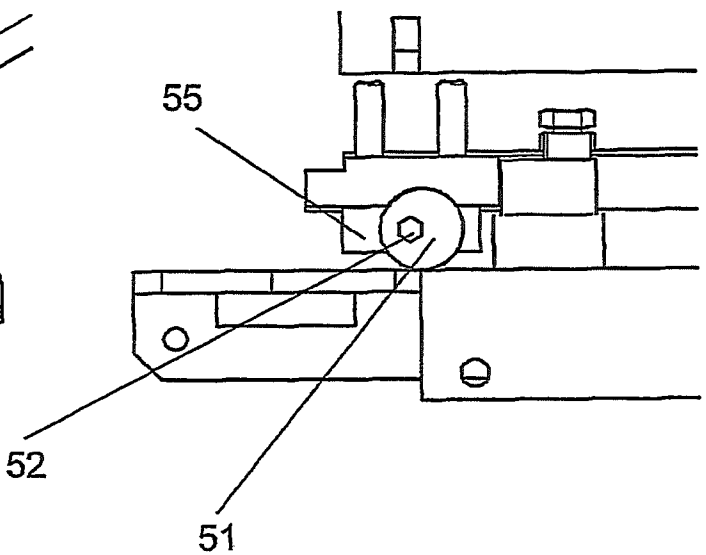
FIGS. 8A and 8B are an isometric view and an end view respectively, showing the comb plate height adjusting means according to the present invention.
Figure 8A:
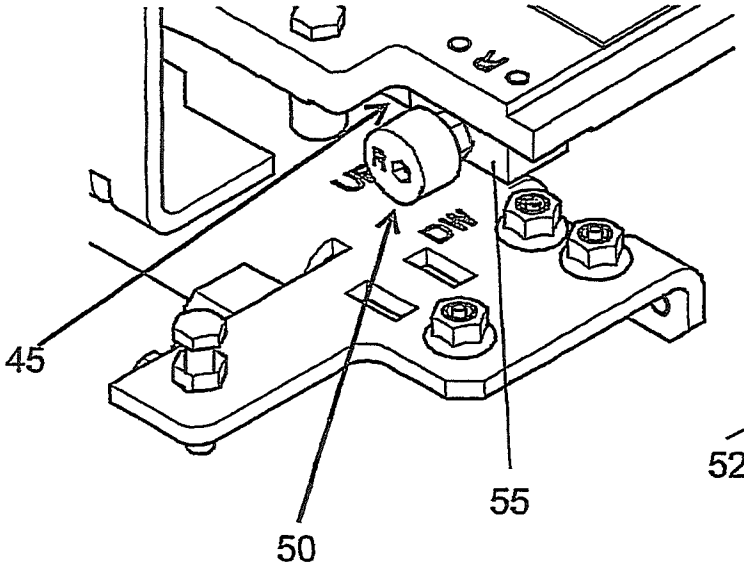
Figure 8C:
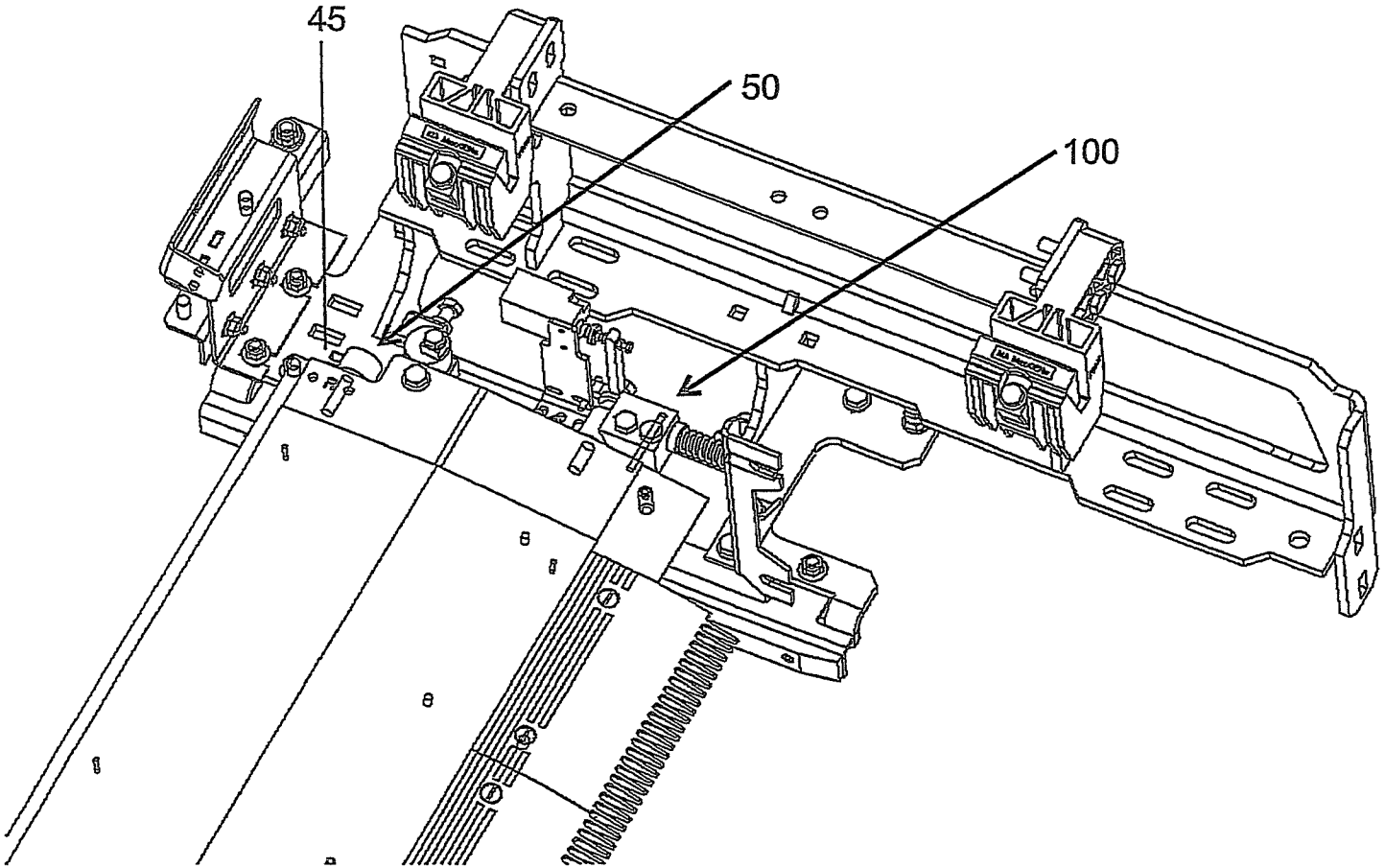
FIG. 8C is an isometric view showing the mounting of the comb plate height adjusting means on the comb plate-comb plate carrier assembly according to the present invention.

As shown in FIG. 8C, the monitoring device 100 for monitoring the position of the comb plate is located in the vicinity of the middle portion of the comb plate-comb plate carrier assembly, closer to the proximal end. The monitoring device 100 comprises a safety switch 110. During the operation of the escalator, the comb plate will be displaced backward and/or upward due to abnormal situations such as the collision between steps and the comb of the comb plate or objects being stuck between teeth of the steps and the comb of the comb plate. The backward and/or upward displacement of the comb plate will actuate at least one safety switches 110 so as to stop the operation of the escalator.

Figure 9:
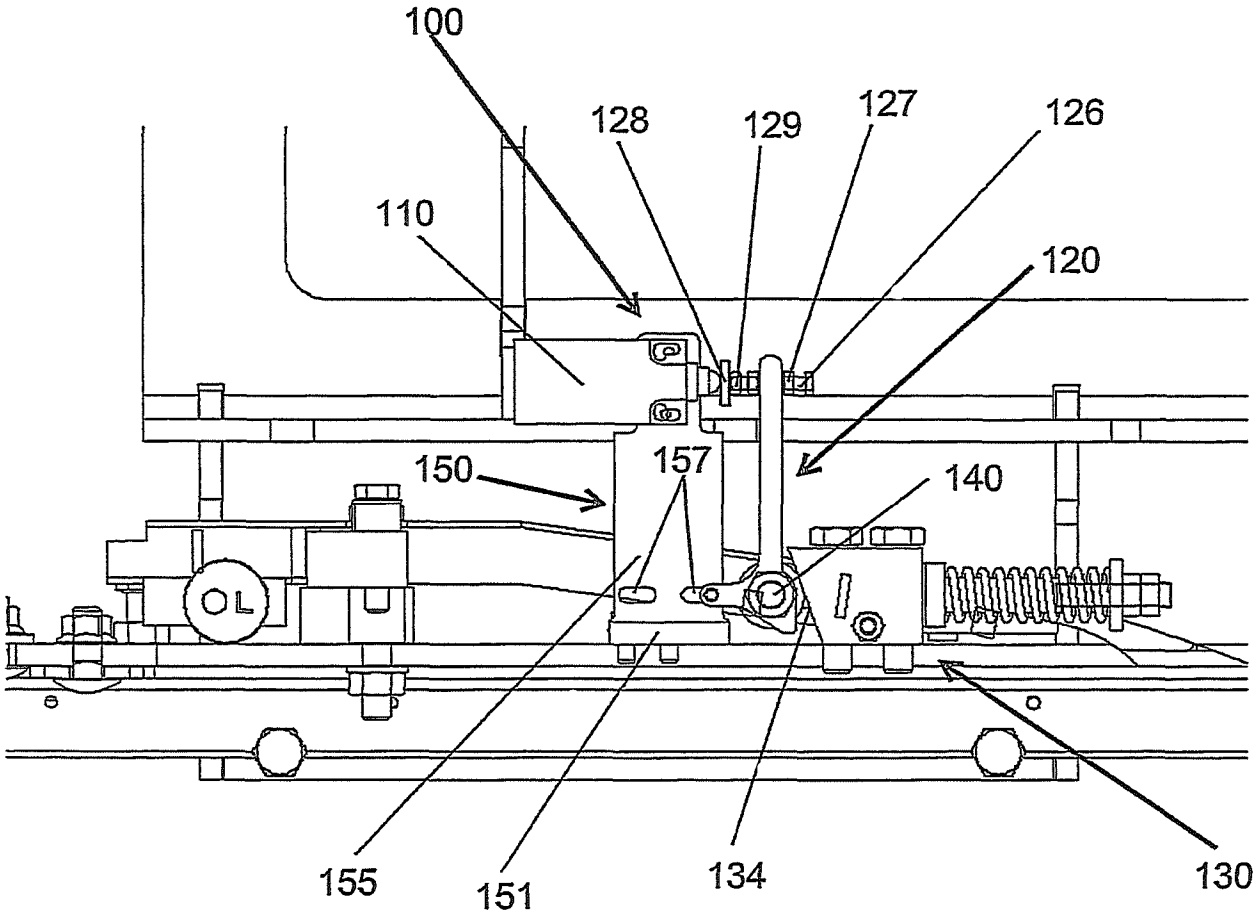
FIG. 9 is a front view of the monitoring device for monitoring the position of the comb plate according to the present invention.
Figure 10:
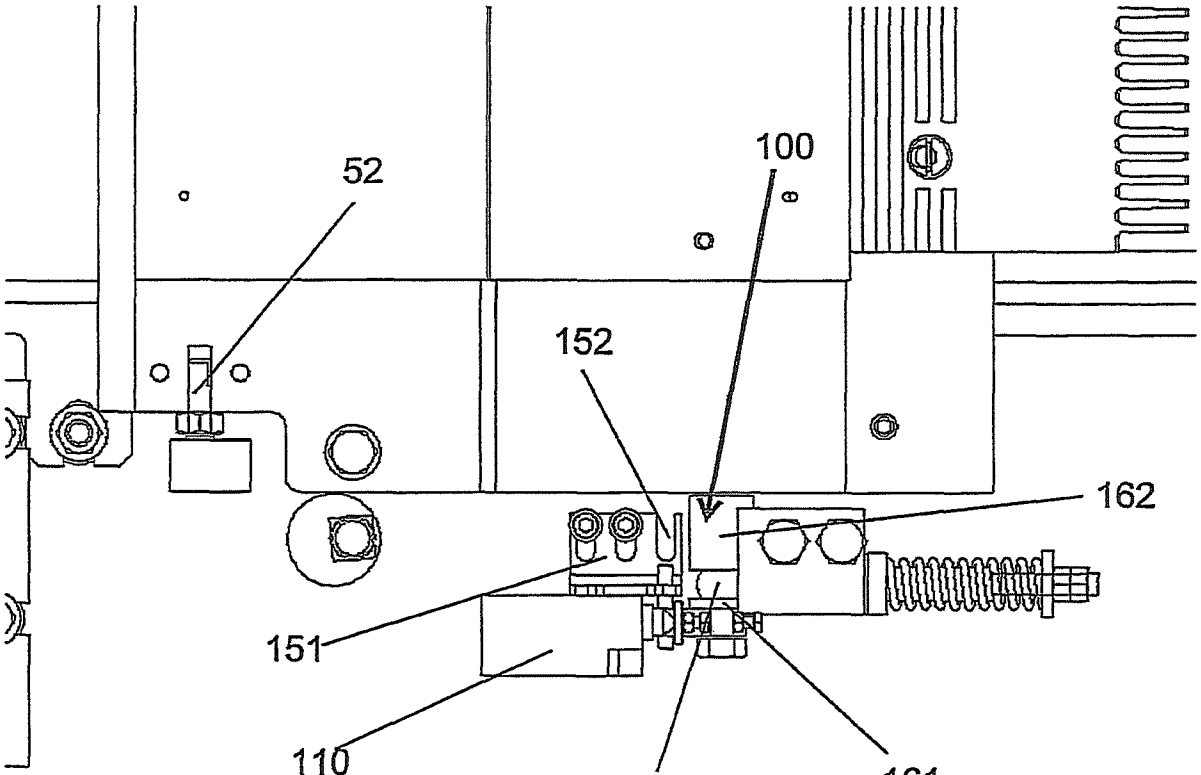
FIG. 10 is a top view of the monitoring device for monitoring the position of the comb plate according to the present invention.
Figure 12:
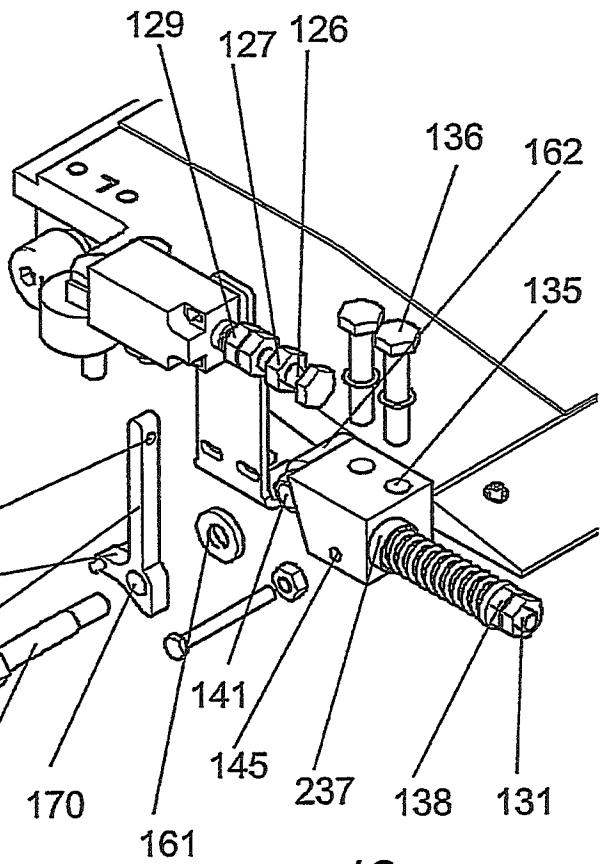
FIG. 12 is an exploded perspective view of the monitoring device for monitoring the position of the comb plate according to the present invention.
Figure 11:
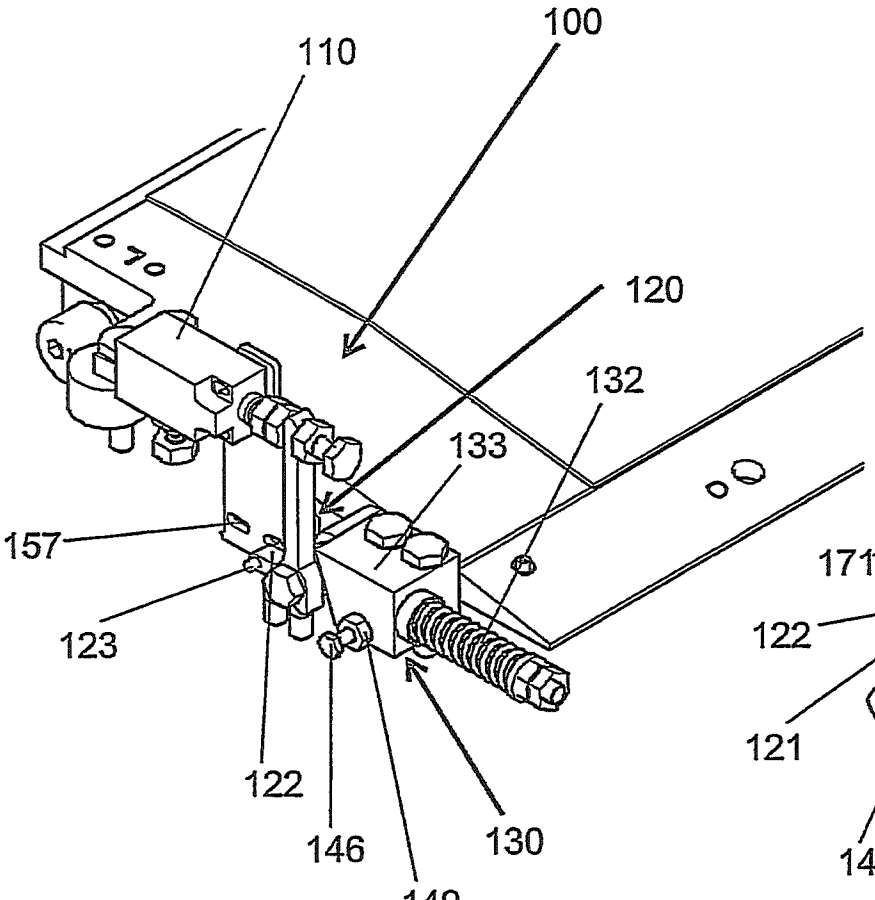
FIG. 11 is an isometric view showing the monitoring device for monitoring the position of the comb plate according to the present invention.
Figure 13A:
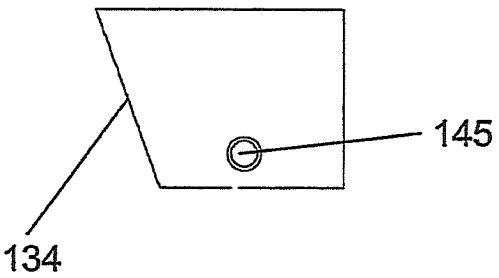
FIG. 13A is a front view of the wedge block used for the monitoring device.
Figure 13B:
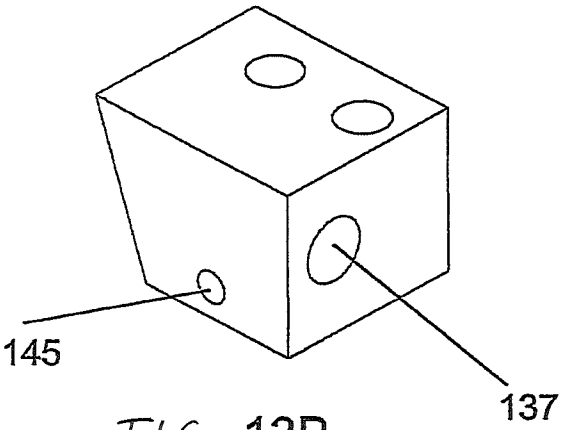
FIG. 13B is an isometric view of the wedge block.
Figure 13C:
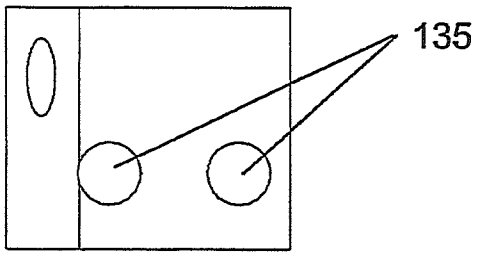
FIG. 13C is a bottom view of the wedge block.

Next referring to FIGS. 9 to 12, the monitoring device according to the present invention for monitoring the position of the comb plate is shown, wherein FIG. 9 is a front view of the monitoring device, FIG. 10 is a top view of the monitoring device, FIG. 11 is an perspective view of the monitoring device in an assembled state, and FIG. 12 is an exploded perspective view of the monitoring device. As shown in FIGS. 9 to 12, the monitoring device mainly comprises the following components: a safety switch 110, a safety switch actuating rod assembly 120 and a restoration device 130.

As stated above, when the abnormal situations occur such as the collision between steps and the comb of the comb plate or objects being stuck between the teeth of the steps and the comb of the comb plate, the safety switch is actuated to cut off the power supply and stop the operation of the escalator. The actuation of the safety switch is realized by the safety switch actuating rod assembly.

As shown in FIGS. 11 and 12, the safety switch actuating rod assembly 120 mainly comprises a safety switch actuating rod 121 and a safety switch actuating pin 126. A lower end of the safety switch actuating rod 121 in a vertical direction is formed with a hole 170, the safety switch actuating rod is mounted to a shaft 140 by means of the hole 170 and is rotatable about the shaft 140, while the shaft 40 is fastened to the comb plate. The safety switch actuating pin 126 is disposed at an upper end of the safety switch actuating rod in the vertical direction. The upper end of the safety switch actuating rod 121 is formed with a unthreaded hole or threaded hole 171, the safety switch actuating pin 126 in a form of a bolt is mounted in the hole 171. As shown in FIGS. 9, 11 and 12, the actuating pin is fastened to the safety switch actuating rod by means of nuts 127 at both sides of the safety switch actuating rod, and at the same time, the axial position of the actuating pin relative to the safety switch actuating rod may be adjusted. A washer-like nut 128 (see FIG. 9) with a greater diameter is disposed at an end of the actuating pin 126 on the side of the safety switch, the washer-like nut 128 is axially fixed to the actuating pin 126 by a nut 129, and the axial position of the washer-like nut relative to the actuating pin may be adjusted. The actuating pin engages and actuates the safety switch by means of the washer-like nut and/or the end of the actuating pin 126. By the way, the washer-like nut 128 may also be omitted.

Further referring to FIGS. 9, 11 and 12, at the lower end of the safety switch actuating rod 121 in a vertical direction, the safety switch actuating rod 121 is provided with an extension part 122 extending towards the side where the safety switch is located, the extension part being substantially parallel to the safety switch actuating rod. The end of the extension part remote from the safety switch actuating rod is provided with a pin 123 which extends substantially parallel to the shaft 140. The pin 123 may be integrally formed with the extension part 122, or fixedly mounted in a hole formed on the extension part 122. As shown in FIGS. 9 and 10, a mounting bracket 150 in a form of angle plate is disposed inside of the extension part and at a position near the shaft 140, the mounting bracket includes a first plate part 151 and a second plate part 155 substantially perpendicular to the first plate part. The first plate part 151 is formed with several elongated slots 152 extending in parallel to the shaft and opening to the comb plate. By means of the elongated slots, the mounting bracket 150 is fastened to the comb plate carrier by bolts, and the fastening position of the mounting bracket 150 may be adjusted. The second plate part 155 of the mounting bracket is located at the side remote from the comb plate, and is formed with several holes 156 at a portion thereof remote from the first plate part (refer to FIG. 4A), so as to fasten the safety switch by bolts passing through the holes, and to this end the safety switch is formed with threaded holes. At a lower portion of the second plate part 155 adjacent to the first plate part 151, the second plate part 155 is formed with elongated holes 157 extending in parallel to the horizontal displacement direction of the comb plate, the elongated holes 157 are at the same height as the pin 123. The number of the elongated holes 157 may be one or more than one, e.g. two, such that a single mounting bracket 150 may be used universally at both lateral sides. When the monitoring device is assembled, the pin 123 is disposed in the elongated hole 157 which is used as a guide channel for the pin. When the comb plate is displaced backward, the safety switch actuating rod 121 is displaced backward together with the comb plate. So the length of the guide channel 157 should at least accommodate the maximum backward displacement of the comb plate. On the other hand, the size of the guide slot 157 in vertical direction is substantially equal to or slightly greater than the diameter of the pin 123, such that when the safety switch actuating rod 121 is displaced upward along with the upward displacement of the comb plate, an upper edge of the guide slot 157 abuts against the pin 123 to prevent the pin from being displaced upward, whereby causing the safety switch actuating rod to rotate about the shaft 140.

As shown in FIGS. 9 to 13C, the restoration device 130 of the monitoring device mainly comprises: a pin 131, a helical spring 132 and a wedge block 133. As shown in FIGS. 12 and 13A, 13B, 13C, the wedge block has an inclined surface 134 on the side facing the shaft 140 (see FIGS. 9 and 13) and is formed with two holes 135 extending in a vertical direction, the wedge block is fastened to the comb plate carrier by bolts 136 passing through the holes. In addition, the wedge block is formed with a hole 137 extending horizontally in the length direction of the comb plate carrier to allow the pin 131 to pass through. The diameters of the hole 137 and the pin 131 are so defined that the pin 131 can move upward with a suitable movement amount relative to the wedge block in the vertical direction, which will be discussed later. The pin 131 extends through the horizontally extending hole 137 on the wedge block, with both ends thereof respectively projecting from the wedge block. An end 341 of the pin on the side of the safety switch is hinged to the shaft 140, to this end, the end 341 of the pin 131 is provided with a hole 141 such that the pin may be fitted over the shaft 140 and pivot about the shaft. The helical spring 132 is fitted over the pin on the side of the pin remote from the safety switch. An end of the helical spring on the side of the wedge block abuts the wedge block via a cup-shaped member 237, the bottom of the cup-shaped member is formed with a hole for the pin to pass through; an end of the helical spring remote from the wedge block is fastened by a nut 138 and a washer. In an assembled state, the helical spring is in a compressed state and acts on the shaft by its resilience force and acts on the comb plate through the shaft, such that the comb plate remains in its normal operation position. In addition, the wedge block 133 is formed with a hole 145 extending in a lateral direction of the comb plate. The hole may be a threaded hole over its entire length, or one part is a threaded hole and the other part is an unthreaded hole. A bolt 146 is mounted in the hole for centering the comb plate laterally, the bolt 146 is fastened by a nut 149 after adjustment. During the actual assembling, assembly error often occurs, leading to bad engagement between the teeth of the step and the comb of the comb plate. With the adjusting means for centering the comb plate laterally, good engagement between the teeth of the step and the comb of the comb plate can be realized by adjusting the lateral position of the comb plate.

As shown in FIGS. 9 to 12, a washer 161 and a sleeve 162 used as a roller are fitted to the shaft 140, wherein the washer 161 is located between the hinged end of the pin 131 and the safety switch actuating rod 121, while the roller 162 is mounted between the hinged end of the pin and the comb plate, and the roller 162 is mounted on the shaft 140 such that the roller can rotate about the shaft. In the assembled state, the roller 162 abuts against the inclined surface 134 of the wedge block.

The operation of the monitoring device is explained below. As stated above, the helical spring acts on the shaft by its resilience force and acts on the comb plate through the shaft, such that the comb plate remains in its normal operation position.

During the operation of the escalator, the comb plate will be displaced backward and/or upward when abnormal situations take place such as the collision between steps and the comb of the comb plate or objects being stuck between teeth of the steps and the comb of the comb plate.

For example, when the comb plate is displaced backward, the shaft 140 will be displaced backward along with the comb plate, and bring the safety switch actuating rod assembly 120 to move back together, whereby the actuating pin 126 fastened to the upper end of the safety switch actuating rod is also displaced backward. As a result of the backward displacement of the safety switch actuating rod assembly, the actuating pin 126 engages and actuates the safety switch 110, the power supply is cut off and the operation of the escalator is stopped. During the backward displacement of the comb plate, the helical spring 132 is further compressed. When the fault is removed to restore the normal operation of the escalator, the comb plate returns to its normal operation position under the action of the spring.

When the comb plate is displaced upward, the shaft 140 will be displaced upward along with the comb plate. At the same time, since the shaft 140 abuts against the inclined surface 134 of the wedge block via the roller 162, the comb plate together with the shaft 140 is also displaced backward while being displaced upward due to the action of the inclined surface. On the other hand, since the pin 123 on the extension part 122 of the safety switch actuating rod 121 is located in the guide channel 157 of the mounting bracket 150, and the upper edge of the guide channel abuts against the pin to prevent the pin from being displaced upward, the safety switch actuating rod rotates about the shaft 140 counterclockwise (FIG. 9). As a result of the rotation of the safety switch actuating rod and the displacement along with the shaft 140, the actuating pin 126 engages and actuates the safety switch 110, the power supply is cut off and the operation of the escalator is stopped. During the upward and backward displacement of the comb plate, the helical spring is further compressed. When the fault is removed to restore the normal operation of the escalator, the comb plate returns to its normal operation position under the action of the spring.

It can be seen from the above that the monitoring device of the present invention can not only monitor the displacement of the comb plate in horizontal direction, but also the displacement of the comb plate in vertical direction, such that all abnormal situations of the escalator may be monitored.

In the above embodiments, the shaft 140 is fixedly mounted relative to the comb plate, and the safety switch actuating rod 121 is rotatably mounted to the shaft 140. As a modification, the shaft 140 may be rotatable relative to the comb plate while the safety switch actuating rod 121 is fixedly mounted to the shaft 140, which may realize the same technical effect.

In the above embodiment, the bolts 146 are provided to center the comb plate laterally. However, the technical solution of the present invention can also exclude the adjustment means for centering the comb plate laterally, although the technical solution with the adjustment means is a preferable one.

In addition, in the above embodiment, the monitoring device can not only monitor the displacement of the comb plate in horizontal direction, but also the displacement of the comb plate in vertical direction. However, as an alternative solution, the monitoring device can be configured to monitor the displacement of the comb plate in horizontal direction only. In this case, the wedge block 133 can be replaced by a simple block, without forming the inclined surface 134, and the roller 162 can also be omitted. Furthermore, the safety switch actuating rod 121 can also be fixedly mounted to the shaft 140. In this case, the elongated hole 157 as the guide slot can be omitted. In addition, as an alternative solution, the inclined surface 134 can also be replaced by a curved surface, and the safety switch actuating pin 126 is not limited to the type shown in the figures, other types of safety switch actuating pins can also be used, which is obvious to those skilled in the art.

Figure 14:
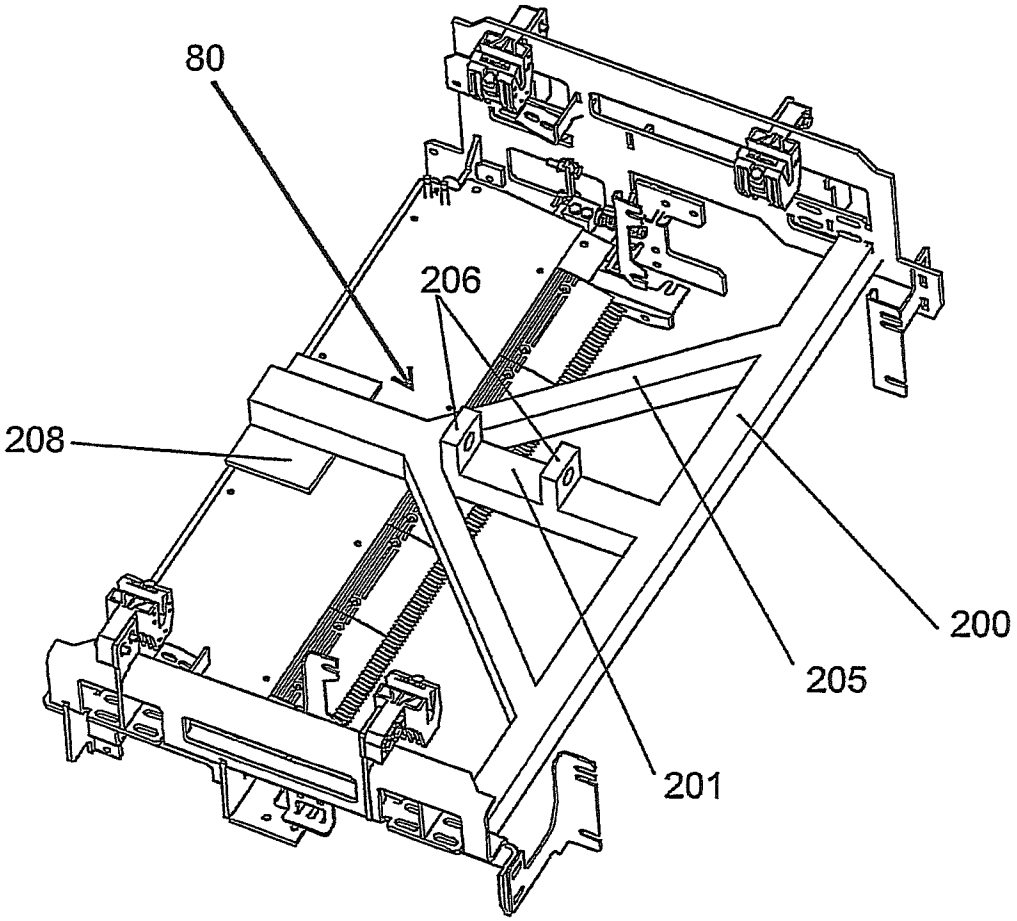
FIG. 14 is an isometric view of a T-shaped lifting tool used for the comb plate-comb plate carrier assembly according to the present invention.
Figure 15B:
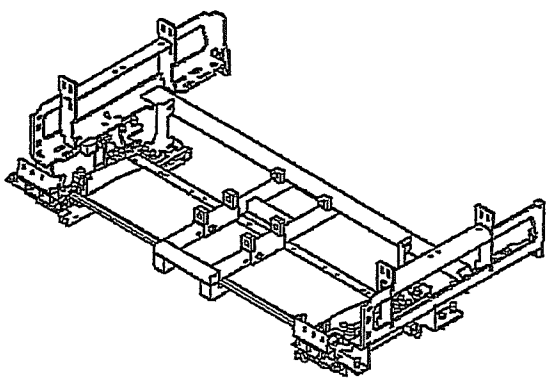
FIGS. 15A and 15B are isometric views respectively showing the lifting state of the comb plate-comb plate carrier assembly.
Figure 15A:
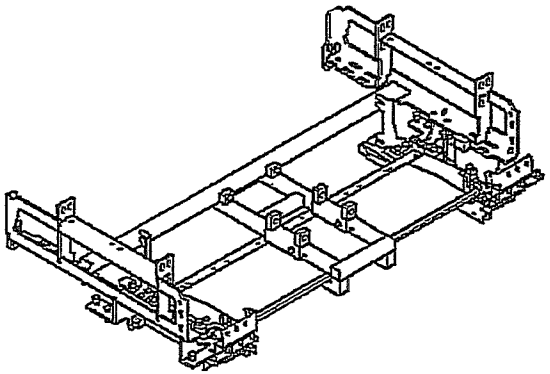
Figure 16:
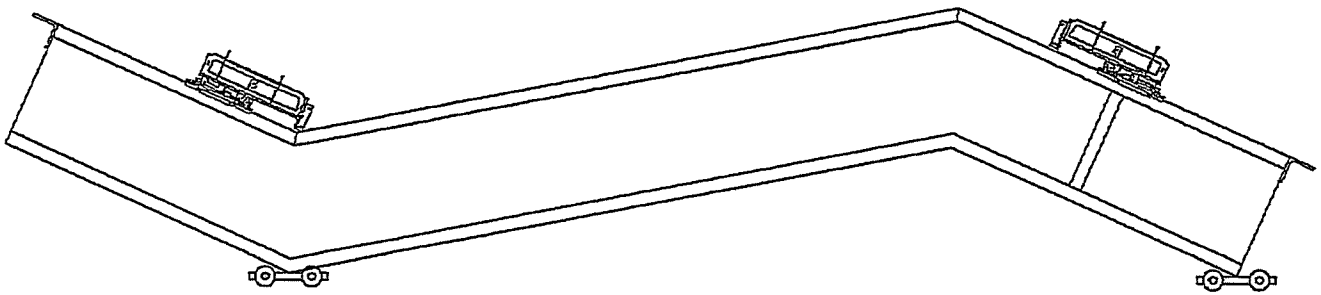
FIG. 16 shows a mounting state of the comb plate-comb plate carrier on the truss.

Next referring to FIG. 14, a T-shaped lifting tool used for the comb plate-comb plate carrier assembly according to the present invention is shown. As shown in FIG. 14, the T-shaped lifting tool 80 is generally of T-shape and comprises a rod 200 and a rod 201 which is perpendicular to and connected to the rod 200 at the middle of the rod 200. In order to improve the strength and rigidity of the T-shaped lifting tool, two reinforcing rods 205 can be selectively used, one end of the two reinforcing rods is connected to the rod 201 at substantially the middle position of the rod 201, and the other end of the two reinforcing rods are respectively connected to the rod 202 at the position adjacent to both ends of the rod 200. A panel member 208 is provided at the end of the rod 201 opposite to the rod 200, for connecting or engaging the comb plate. In addition, two lifting eyes 206, which are spaced apart from each other, are provided on the rod 201, wherein the lifting eye adjacent to the rod 200 is used for lifting the comb plate-comb plate carrier assembly mounted to an upper head, while the lifting eye remote from the rod 200 is used for lifting the comb plate-comb plate carrier assembly mounted to a lower head. The positions of two lifting eyes 206 are so arranged that the weight center of the comb plate-comb plate carrier assembly is located between two lifting eyes 206 and that, during lifting and installation, the comb plate-comb plate carrier assembly is substantially parallel to an upper chord of the truss or a lower chord of the truss, as shown in FIGS. 15*a*, 15*b* and 16.

During the transportation and assembling of the comb plate-comb plate carrier assembly, the lifting tool on one hand connects or engages the comb plate by means of the panel member 208, bolts may be used for the connection, to this end, bolt holes may be formed on the panel member 208 and the comb plate; and on the other hand connects the comb plate carriers by means of the two ends of the rod 200, bolts may be similarly used to connect the rod 200 and the comb plate carriers. When assembling the comb plate-comb plate carrier assembly, a hoisting device is used to lift the comb plate-comb plate carrier assembly and move it to its mounting position. Depending on whether the part to be assembled is the upper head or the lower head, the hoisting device selects the corresponding lifting eye to lift the comb plate-comb plate carrier assembly, such that the comb plate-comb plate carrier assembly is substantially parallel to the upper chord of the truss or the lower chord of the truss of the escalator, thereby to facilitate the comb plate-comb plate carrier assembly to be mounted on the corresponding chord of the upper truss or the lower truss.

In the above embodiment, the lifting tool is equipped with two lifting eyes, obviously it is also feasible to provide only one lifting eye.

Figure 17:
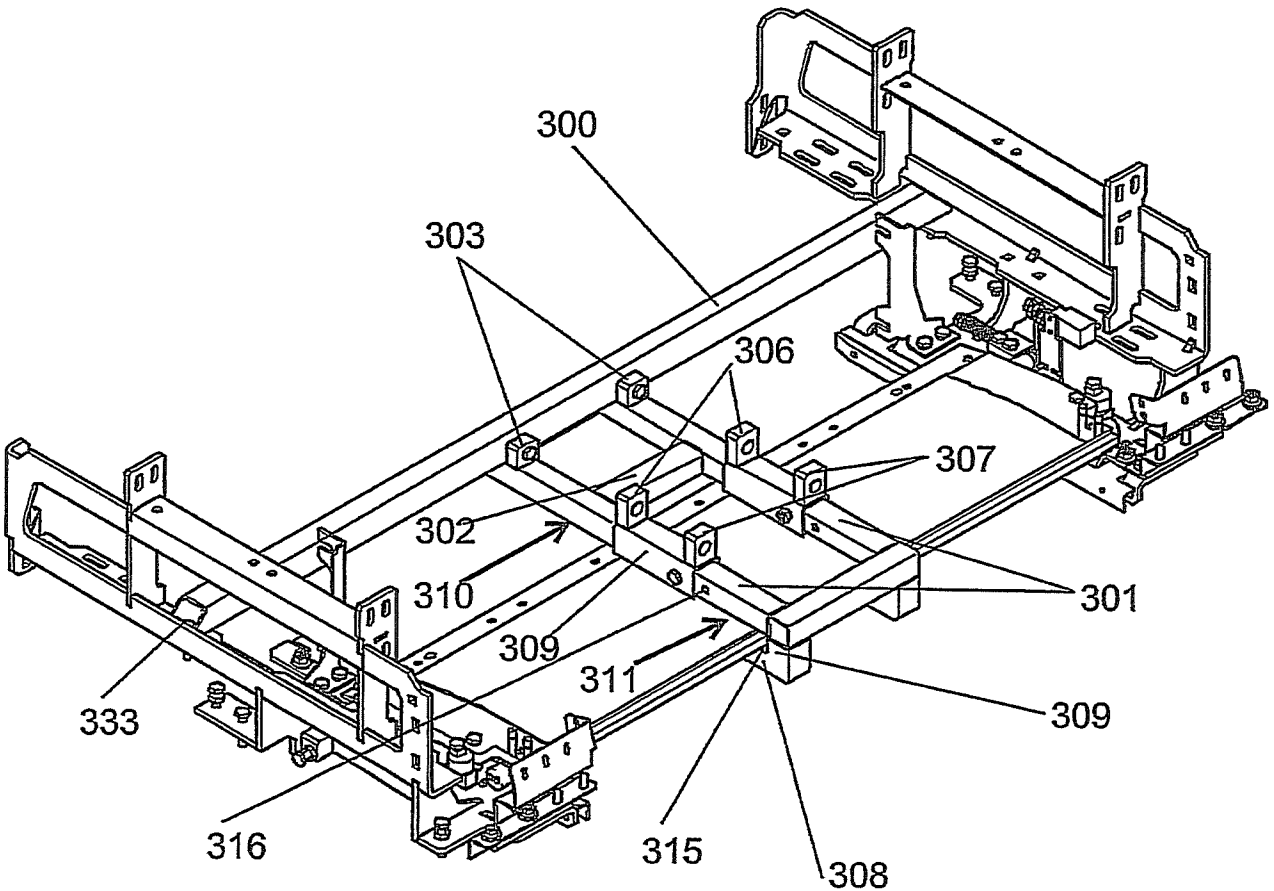
FIG. 17 is an isometric view showing another embodiment of the T-shaped lifting tool used for the comb plate-comb plate carrier assembly according to the present invention.

FIG. 17 shows another embodiment of the T-shaped lifting tool used for the comb plate-comb plate carrier assembly according to the present invention. As shown in FIG. 17, the T-shaped lifting tool according to the second embodiment of the invention is generally of T-shape, and comprises a rod 300 and two spaced rods 301 which are perpendicular to and connected to the rod 300 at the middle portion of the rod 300, the two rods 301 are connected to each other by a traverse rod 302. As shown in the figure, a lug 303 is disposed at an end of each of the rods 301 on the side of the rod 300 and is formed with a hole. Correspondingly, the rod 300 is also formed with holes, the rod 300 and the rods 301 are connected to each other by bolts. Two pairs of lifting eyes 306 and 307 are provided at a substantially middle portion of the rods 301 and are spaced from each other in a length direction of the rods 301. The pair of lifting eyes 306 adjacent to the rod 300 is used for lifting the comb plate-comb plate carrier assembly mounted to the upper head, while the pair of lifting eyes 307 remote from the rod 300 is used for lifting the comb plate-comb plate carrier assembly mounted to the lower head. The positions of two pairs of lifting eyes 306 and 307 are so arranged that the weight center of the comb plate-comb plate carrier assembly is located between the two pairs of lifting eyes and that, during lifting and installation, the comb plate-comb plate carrier assembly is substantially parallel to the chord of the upper truss or the chord of the lower truss, as shown in FIGS. 15*a*, 15*b* and 16.

In addition, as shown in the figure, a further pair of rods 308 is disposed at the side of the rods 301 remote from the rod 300, and the rods 308 are connected to the rods 301 via a connecting portion 309 and are spaced from the rods 301, a gap 315 is formed between the rods 308 and the rods 301. The comb plate can be accommodated in the gap 315 so that, in the actual operation, the rods 308 are used to support the comb plate and the connection portions 309 forms a stop for delimiting the insertion depth of the comb plate. Furthermore, it is preferable that the rods 308 are formed with bolt holes extending in vertical direction, and bolts are mounted in the bolt holes to abut against and support the comb plate accommodated in the gap 315.

In addition, as shown in FIG. 17, the rod 301 is in the form of a rectangular tube and is a split rod comprising a part 310 and a part 311 which are connected with each other by using a sleeve 309. For the purpose of connection, the portions of the part 310 and the part 311, which are adjacent to each other, are formed with the holes 316, and the sleeve 309 is formed with corresponding holes, whereby the two parts are connected to each other by bolts. Furthermore, in order to be adapted to comb plates with different widths, the rod 301 is designed to have a structure whose length is adjustable, to this end, the sleeve 309 is formed with a plurality of holes, and the length of the rod 301 is achieved by selecting different holes for connection. The means of adjusting the length of the rod 301 is not limited to the aforementioned one, and other structures may be adopted. For example, the ends of the part 310 and the part 311, which are adjacent to each other, are respectively formed with holes with inner screw thread, while the sleeve 309 is formed with corresponding outer screw threads. Furthermore, it is obvious for those skilled in the art that the rod 301 may be an integral structure whose length is not adjustable.

During the transportation and assembling of the comb plate-comb plate carrier assembly, on one hand, the lifting tool is connected with the comb plate by inserting the comb plate into the gap 315 between the rods 301 and the rods 308, and is in reliable engagement with the comb plate by screwing the bolts on the rods 308; and on the other hand, the lifting tool is connected with the comb plate carrier using the two ends of the rod 3200. To this end, as shown in the figure, the panel, which is in contact with the comb plate carrier, at both ends of the rod 300 is formed with a hole 333, and the comb plate carrier is formed with a corresponding hole, through which holes the two members are connected by bolts. In order to facilitate connection, the rod 300 is machined to have two beveled ends so as to expose the panel at the two ends of the rod 300 which is in contact with the comb plate carrier. The means for connecting the rod 300 and the comb plate carrier is not limited to the aforementioned one, and other means can be used, for example, the two ends of the rod 300 may be formed with through holes extending through the upper and lower panels, and the rod is connected with the comb plate carrier by bolts passing through the through holes. When assembling the comb plate-comb plate carrier assembly, a hoisting device is used to lift the comb plate-comb plate carrier assembly and move it to its mounting position. Depending on whether the part to be assembled is the upper head or the lower head, the hoisting device selects the corresponding lifting eyes to lift the comb plate-comb plate carrier assembly, such that the comb plate-comb plate carrier assembly is substantially parallel to the chord of the upper truss or the chord of the lower truss of the escalator, thereby to facilitate the comb plate-comb plate carrier assembly to be mounted on the corresponding chord of the upper truss or the lower truss.

The T-shaped lifting tool of the present invention can not only be used for lifting, but also used for fixing and maintaining the relative position relationship between the comb plate carriers and the comb plate, thereby achieving the technical effect of one tool with multiple purposes.

The present invention is described above in connection with the accompanying drawings and embodiments. It should be understood by those skilled in the art that the above embodiments are given by way of illustration only and thus are not limitative of the present invention. Various modifications may be made to the embodiments without departing from the scope and spirit of the present invention.

What is claimed is:

1. A comb plate-comb plate carrier assembly for an escalator or a moving walk, said escalator or moving walk comprising steps or pallets, and a balustrade with a handrail, said assembly being arranged on a head of the escalator or moving walk and being mounted on a truss of the escalator or moving walk, wherein said comb plate-comb plate carrier assembly comprising:

a comb plate; and a pair of opposed comb plate carriers for carrying the comb plate, each comb plate carrier having an inner edge adjacent the comb plate and an outer edge spaced from the inner edge, a distance between inner edges of the comb plate carriers being greater than a length of the comb plate carrier measured along said distance, wherein said comb plate-comb plate carrier assembly being provided with at least one of the following items:

(a) a guide rail bracket which is fastened to the comb plate carrier and is used to fix a guide rail for the handrail belt, the guide rail bracket comprising a mounting portion and a fixing portion, said mounting portion being fastened to the comb plate carrier, and said fixing portion being formed with a hole and fixing the handrail belt guide rail by means of a bolt extending through the hole;

(b) a supporting bracket which is fastened to the comb plate carrier and is used to support an end of a handrail return-sheave curve fastened to the truss;

(c) comb plate height adjuster provided at either lateral end of said comb plate on a side of the comb plate facing away from the comb for adjusting the height of the comb plate; or (d) monitoring device for monitoring the horizontal displacement and upward displacement of the comb plate.

2. The comb plate-comb plate carrier assembly of claim 1, wherein said comb plate carrier is provided with:

(e) mounting portions for fastening the comb plate carrier to the truss, the mounting portions are located at the positions of the comb plate carrier which are adjacent to the longitudinal ends of the comb plate carrier, said mounting portions are substantially parallel to an upper surface of the truss to which the mounting portions are fastened, and said mounting portions are formed with holes and are connected to a connector fixed to the truss by means of bolts extending through the holes, thereby fastening the comb plate carrier to the truss.

3. The comb plate-comb plate carrier assembly of claim 1, wherein the fixing portion of the guide rail bracket is a panel which is substantially parallel to the guide rail of the handrail belt, and said hole is an elongated one which extends substantially parallel to the guide rail.

4. The comb plate-comb plate carrier assembly of claim 1, wherein said guide rail bracket is fastened to a rib of the comb plate carrier.

5. The comb plate-comb plate carrier assembly of claim 1, wherein said guide rail bracket is a dragon-head-like guide rail bracket, and said guide rail bracket is fastened to a balustrade bracket mounted on the comb plate carrier, said mounting portion is formed with a cutout which corresponds to the mounting slot of the balustrade bracket, said cutout delimits a first mounting portion remote from the comb plate and a second mounting portion adjacent to the comb plate, the first mounting portion is fastened to an end face of a slot wall, which is remote from the comb plate, of the mounting slot of the balustrade bracket by means of bolts, and the second mounting portion is configured to fix an inlet panel bracket by means of bolts.

6. A comb plate-comb plate carrier assembly for an escalator or a moving walk, said escalator or moving walk comprising steps or pallets, and a balustrade with a handrail, said assembly being arranged on a head of the escalator or moving walk and being mounted on a truss of the escalator or moving walk, wherein said comb plate-comb plate carrier assembly comprising:

a comb plate; and a pair of opposed comb plate carriers for carrying the comb plate, wherein said comb plate-comb plate carrier assembly being provided with a supporting bracket which is fastened to the comb plate carrier and is used to support an end of a handrail return-sheave curve fastened to the truss, wherein said supporting bracket comprises a mounting portion and a supporting portion substantially perpendicular to each other, said mounting portion is fastened to the comb plate carrier, and the supporting portion is located on a side adjacent to the comb plate and is formed with a hole open upward, the hole is configured to receive a positioning pin provided to the end of the handrail return-sheave curve; in a assembled state, the supporting portion and the end of the handrail return-sheave curve are connected in one of the following ways:

the positioning pin is formed with external screw thread, and the supporting portion and the end of the handrail return-sheave curve are connected through a nut engaging with the positioning pin; or said positioning pin is used as a rivet, and the supporting portion and the end of the handrail return-sheave curve are connected in the way of rivet connection.

7. The comb plate-comb plate carrier assembly of claim 6, wherein said supporting bracket is in the form of an angle plate, and the supporting portion is formed with two elongated holes open upward, the two elongated holes are configured to receive two positioning pins provided to the end of the handrail return-sheave curve.

8. The comb plate-comb plate carrier assembly of claim 6, wherein said supporting bracket is of T shape, said supporting portion comprises two parts: a lower part located at a lower side relative to the mounting portion, and an upper part located at an upper side relative to the mounting portion, the upper part is formed by forming a cutout of U shape in the mounting portion and bending the portion surrounded by the cutout, the lower part and the upper part are coplanar, and the upper part is formed with a hole open upward.

9. A comb plate-comb plate carrier assembly for an escalator or a moving walk, said escalator or moving walk comprising steps or pallets, and a balustrade with a handrail, said assembly being arranged on a head of the escalator or moving walk and being mounted on a truss of the escalator or moving walk, wherein said comb plate-comb plate carrier assembly comprising:

a comb plate; and a pair of opposed comb plate carriers for carrying the comb plate, wherein said comb plate-comb plate carrier assembly being provided with a comb plate height adjuster provided at either lateral end of said comb plate on a side of the comb plate facing away from the comb for adjusting the height of the comb plate, wherein said comb plate height adjuster is an eccentric roller device, comprising a roller and a roller shaft on which the roller is eccentrically mounted, the roller shaft is attached to the comb plate, and the roller can rotate about an axis of the roller shaft.

10. A comb plate-comb plate carrier assembly for an escalator or a moving walk, said escalator or moving walk comprising steps or pallets, and a balustrade with a handrail, said assembly being arranged on a head of the escalator or moving walk and being mounted on a truss of the escalator or moving walk, wherein said comb plate-comb plate carrier assembly comprising:

a comb plate; and a pair of opposed comb plate carriers for carrying the comb plate, wherein said comb plate-comb plate carrier assembly being provided with a monitoring device for monitoring the horizontal displacement and upward displacement of the comb plate, wherein said monitoring device comprises:

a safety switch fastened to the comb plate carrier;

a safety switch actuating rod assembly for actuating the safety switch; and a restoration device, wherein said safety switch actuating rod assembly comprising:

a safety switch actuating rod, one end of which is attached to a shaft, the shaft is attached to the comb plate, extends in the lateral direction of the comb plate and can move together with the comb plate, and said safety switch actuating rod can rotate about the axis of the shaft, wherein said safety switch actuating pin which is fixedly attached to the other end of the safety switch actuating rod and is configured to actuate the safety switch, wherein said safety switch actuating rod is provided with a pin near said one end which extends substantially parallel to said shaft and is spaced apart by a distance from the shaft, the pin is located in a guide channel extending in a direction of horizontal displacement of the comb plate and is guided by the guide channel, wherein said restoration device comprises:

a pin;

a helical spring; and a wedge block, wherein said wedge block is fastened to the comb plate carrier on a side of the shaft opposed to the safety switch, and has an inclined surface or curved surface on the side facing the shaft, the inclined surface or curved surface forms an acute angle with a mounting surface of the comb plate carrier on which the wedge block is mounted, said wedge block is formed with a through hole extending through the inclined surface or curved surface and the surface opposed to the inclined surface or curved surface, and wherein said pin extends through the through hole, the diameter of the through hole and that of the pin are so defined that the pin can follows the upward displacement of the comb plate, the end of the pin on the side of the shaft is fitted to the shaft, and the helical spring is fitted over the other end portion of the pin extending out of the through hole, one end of the helical spring abuts said wedge block and the other end of the helical spring abuts a stopper fastened to the other end of the pin, and wherein said monitoring device further comprises a roller which is fitted over the shaft and comes into contact with the inclined surface or curved surface.

11. The comb plate-comb plate carrier assembly of claim 10, wherein said one end of the safety switch actuating rod is articulated to the shaft, and the shaft is fixedly attached to the comb plate.

12. The comb plate-comb plate carrier assembly of claim 10, wherein the comb plate-comb plate carrier assembly comprises a mounting bracket fastened to the comb plate carrier, the mounting bracket is formed with holes, the safety switch is fastened to the mounting bracket by means of bolts extending through the holes, and said guide channel is provided in the mounting bracket.

13. The comb plate-comb plate carrier assembly of claim 10, wherein said wedge block is formed with holes perpendicular to said mounting surface of the comb plate carrier, and is fastened to the comb plate carrier by means of bolts extending through the holes.

14. The comb plate-comb plate carrier assembly of claim 10, wherein a washer is mounted on the shaft, the washer is located between said safety switch actuating rod and said pin.

15. The comb plate-comb plate carrier assembly of claim 10, wherein said helical spring abuts the wedge block via a cup-shaped member, the bottom of the cup-shaped member has a hole for the pin to pass through; and said stopper is comprised of a bolt and a washer.

16. The comb plate-comb plate carrier assembly of claim 10, wherein said other end of the safety switch actuating rod is formed with a hole, and said safety switch actuating pin is in the form of a bolt, the bolt extends through said hole and is fixedly attached to the safety switch actuating rod via nuts, and a washer-like nut is attached to the end of the bolt which faces the safety switch.

17. The comb plate-comb plate carrier assembly of claim 10, wherein the wedge block is further formed with a hole extending in the lateral direction of the comb plate, inner screw thread is formed on at least a portion of the hole, a adjusting bolt is mounted in the hole for centering the comb plate laterally.

18. A combination construction, comprising a lifting tool and a comb plate-comb plate carrier assembly in an assembled condition, wherein said comb plate-comb plate carrier assembly comprising:

a comb plate; and a pair of opposed comb plate carriers for carrying the comb plate, wherein said comb plate-comb plate carrier assembly being provided with at least one of the following items:

(a) a guide rail bracket which is fastened to the comb plate carrier and is used to fix a guide rail for the handrail belt, the guide rail bracket comprising a mounting portion and a fixing portion, said mounting portion being fastened to the comb plate carrier, and said fixing portion being formed with a hole and fixing the handrail belt guide rail by means of a bolt extending through the hole;

(b) a supporting bracket which is fastened to the comb plate carrier and is used to support an end of a handrail return-sheave curve fastened to the truss;

(c) comb plate height adjuster provided at either lateral end of said comb plate on a side of the comb plate facing away from the comb for adjusting the height of the comb plate;

(d) monitoring device for monitoring the horizontal displacement and upward displacement of the comb plate, said lifting tool comprising:

a traverse rod;

a longitudinal suspending member which is provided substantially perpendicular to the traverse rod, one end of the longitudinal suspending member is attached to the traverse rod at the central portion of the traverse rod;

an engaging device which is provided at the other end of the longitudinal suspending member and engages with the comb plate; and a lifting eye arranged on the longitudinal suspending member, wherein the ends of the traverse rod are respectively fixedly connected to the corresponding comb plate carriers, so as to fix and maintain the positional relationship between the two comb plate carriers and the comb plate, and the engaging device engages with the comb plate.

19. The combination construction of claim 18, wherein two lifting eyes or two set of lifting eyes, which are spaced apart from each other in the longitudinal direction, are arranged on the longitudinal suspending member, and wherein the two lifting eyes or two set of lifting eyes are so arranged that the weight center of the combination construction is located therebetween.

20. The combination construction of claim 19, wherein the two lifting eyes or two set of lifting eyes are so arranged that, during the lifting and installation of the comb plate-comb plate carrier assembly, the comb plate-comb plate carrier assembly is substantially parallel to the chord of the truss on which it is installed.

21. The combination construction of claim 18, wherein the length of the longitudinal suspending member is adjustable.

22. The combination construction of claim 18, wherein the engaging device comprises a panel provided at the other end of the longitudinal suspending member, the panel is provided with bolt holes and is connected to the comb plate by means of bolts.

23. The combination construction of claim 18, wherein the engaging device comprises a supporting member provided at said other end of the longitudinal suspending member, the supporting member is at a distance from the longitudinal suspending member in the vertical direction and is connected to the longitudinal suspending member via a connecting portion, a space is formed between the supporting member and the longitudinal suspending member, and the comb plate can be accommodated in the space, the connecting portion forms a stop for delimiting the insertion depth of the comb plate.

24. The combination construction of claim 23, wherein the supporting member is formed with bolt holes, bolts are mounted in the bolt holes to abut against the comb plate.

25. The combination construction of claim 18, wherein the longitudinal suspending member is a rod.

26. The combination construction of claim 25, wherein further comprising two reinforcing rods, one end of the two reinforcing rods is respectively connected to the longitudinal suspending member, and the other end of the reinforcing rods is respectively connected to the traverse rod.

27. The combination construction of claim 21, wherein the longitudinal suspending member is a rod in the form of a tube, said rod is a split rod which comprises a first part and a second part which are connected with each other by using a sleeve, the two ends of the sleeve can be inserted into the first part and the second respectively, and the first and second parts as well as the sleeve are formed with holes and are connected together by means of bolts.

28. The combination construction of claim 18, wherein the longitudinal suspending member comprises two longitudinal rods spaced apart laterally, the two longitudinal rods are connected through lateral connecting rods extending therebetween.

29. The combination construction of claim 21, wherein the longitudinal suspending member comprises two longitudinal rods spaced apart laterally, the two longitudinal rods are connected through lateral connecting rods extending therebetween, each longitudinal rod is in the form of a tube and is a split one which comprises a first part and a second part which are connected with each other by using a sleeve, the two ends of the sleeve can be inserted into the first part and the second part respectively, and the first and second parts as well as the sleeve are formed with holes and are connected together by means of bolts.

30. The combination construction of claim 28, wherein the engaging device comprises a supporting member provided at said other end of the longitudinal suspending member, the supporting member comprises two supporting rods which are laterally spaced apart from each other, each supporting rod is connected to the corresponding longitudinal rod.

31. The combination construction of claim 30, wherein two supporting rods are connected with each other through lateral connecting rods extending therebetween.

32. The combination construction of claim 18, wherein the two ends of the traverse rod are formed with a hole and are fastened to the corresponding comb plate carrier through a bolt.

* * * * *